US007883282B2

(12) United States Patent
Izuchi et al.

(10) Patent No.: US 7,883,282 B2
(45) Date of Patent: Feb. 8, 2011

(54) IMAGE FORMING APPARATUS

(75) Inventors: Masatoshi Izuchi, Ichinomiya (JP); Yuji Koga, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 653 days.

(21) Appl. No.: 11/855,389

(22) Filed: Sep. 14, 2007

(65) Prior Publication Data

US 2008/0203645 A1 Aug. 28, 2008

(30) Foreign Application Priority Data

Sep. 15, 2006 (JP) ..... 2006-251331

(51) Int. Cl.

| | |
|---|---|
| ***B41J 29/38*** | (2006.01) |
| ***B41J 13/00*** | (2006.01) |
| ***B65H 5/06*** | (2006.01) |
| ***B65H 3/06*** | (2006.01) |

(52) U.S. Cl. ..... 400/76; 400/578; 400/624; 400/629; 347/104

(58) Field of Classification Search ..... None
See application file for complete search history.

(56) References Cited

U.S. PATENT DOCUMENTS

| | | | | |
|---|---|---|---|---|
| 6,659,444 | B2 | 12/2003 | Kawarama | |
| 7,415,239 | B2 * | 8/2008 | Saito et al. | 399/388 |
| 7,607,661 | B2 * | 10/2009 | Akiyama et al. | 271/265.01 |
| 7,628,392 | B2 * | 12/2009 | Shiohara et al. | 271/9.08 |
| 2002/0117797 | A1 | 8/2002 | Kawarama | |
| 2006/0022401 | A1 | 2/2006 | Akiyama et al. | |

FOREIGN PATENT DOCUMENTS

| | | | |
|---|---|---|---|
| JP | 08090858 | A * | 4/1996 |
| JP | 8-225239 | | 9/1996 |
| JP | 9-220835 | | 8/1997 |
| JP | 9234903 | A2 | 9/1997 |
| JP | 2001-063837 | | 3/2001 |
| JP | 2002-249237 | | 9/2002 |
| JP | 2003-104583 | | 4/2003 |
| JP | 2003211752 | A2 | 7/2003 |
| JP | 2003276906 | A2 | 10/2003 |
| JP | 2006-036463 | | 2/2006 |

OTHER PUBLICATIONS

Japanese Office Action for Patent Application No. 2006-251331, mailed Jul. 15, 2008, 5 pages.

* cited by examiner

*Primary Examiner*—Daniel J Colilla
(74) *Attorney, Agent, or Firm*—Banner & Witcoff Ltd.

(57) ABSTRACT

An image forming apparatus includes a sheet feed tray for loading a recording sheet, a sheet feed roller that conveys the recording sheet toward an image forming device, a conveyor roller that is disposed downstream of the sheet feed roller in a recording sheet conveying direction and that applies a conveying force on the recording sheet, a sheet position detection device that detects a position of the recording sheet in a conveying path, and a conveyor roller control device that controls a rotation amount of the conveyor roller in accordance with the detected position of the recording sheet. The control device allows the rotation amount of the conveyor roller to become greater, when a recording sheet contacts the sheet feed roller and the conveyor roller, than a rotation amount of the conveyor roller when the recording sheet contacts the conveyor roller but might not contact the sheet feed roller.

8 Claims, 18 Drawing Sheets

IMAGE FORMING APPARATUS

CROSS REFERENCE TO RELATED APPLICATION

This application claims priority from Japanese Patent Application No. 2006-251331, filed on Sep. 15, 2006, the entire subject matter of which is incorporated herein by reference.

FIELD

Aspects of the invention relate to an image forming apparatus. In particular, aspects are effective when being adopted in an image forming apparatus including an inkjet type image forming device.

BACKGROUND

In an inkjet-type image forming apparatus (hereinafter, referred to as an inkjet printer), images or letters/characters are recorded on a recording sheet in a well-known manner. For example, a recording sheet is displaced or conveyed while ink is not ejected onto the recording sheet from a recording head. Ink is ejected onto the recording sheet from the recording head while the recording head reciprocates to scan while the recording sheet remains at rest. That is, in the inkjet printer, an image is formed on a recording sheet by alternately conveying, intermittently, a recording sheet and recording of an image on the recording sheet.

As described above, in the inkjet printer, an image is formed by which a recording sheet is intermittently conveyed. Therefore, if ink positions where ink droplets adhere to or land on the recording sheet deviate from their expected landing positions because of variations in a conveying amount of the recording sheet among each conveyance white streaks (lines) or dark streaks (lines) extending in a direction parallel to a scanning direction of the recording head (a main scanning direction) tend to appear on the recording sheet (hereinafter, such a recording failure is referred to as "banding").

As is clear from the above description, the conveying amount of the recording sheet needs to be accurately controlled in order to avoid an occurrence of banding. However, thicknesses and surface conditions of recording sheets vary among types. Thus, it is difficult to accurately convey all types of recording sheets.

In one example, two sensors are provided at a predetermined distance therebetween in a recording sheet conveying direction. A rotation amount of a conveyor roller is corrected in accordance with a ratio between a rotation amount (a drive amount) of a conveyor roller while a recording sheet to be used is being conveyed between the sensors and a rotation amount of a conveyor roller while a reference recording sheet is being conveyed between the sensors.

Generally, in a conveying path extending from a sheet feed tray to an image forming portion (a recording head), at least a sheet feed roller and a conveyor roller are provided. The sheet feed roller conveys a recording sheet to the image forming portion by rotating while contacting the recording sheet placed in the sheet feed tray. The conveyor roller is disposed downstream of the sheet feed roller in the conveying direction to apply a conveying force onto the recording sheet by rotating while contacting the recording sheet.

Generally, a peripheral speed of the sheet feed roller is smaller than that of the conveyor roller. Therefore, while a recording sheet being conveyed is in contact with the conveyor roller at its leading edge in the conveying direction and is in contact with the sheet feed roller at its trailing edge in the conveying direction, the recording sheet may experience a backward force resulting from the relatively slower rotation speed of the sheet feed roller. Thus, a conveying load on the conveyor roller becomes larger (i.e., a greater conveying force is needed to convey the recording sheet forward).

When the conveying load on the conveyor roller reaches a load threshold, the recording sheet slips from the conveyor roller. Thus, in some instances, the conveying amount of the recording sheet cannot be accurately controlled, thereby causing banding on the recording sheet.

SUMMARY

Aspects of the invention reduce the number of occurrences of banding due to slippage of a recording sheet from a conveyor roller.

According to one aspect of the invention, an image forming apparatus includes an image forming device that forms an image on a recording sheet and a sheet feed tray that is configured to be loaded with a recording sheet to be conveyed to the image forming device. The image forming apparatus further includes a sheet feed roller that conveys the recording sheet toward the image forming device by rotating while contacting the recording sheet. The image forming apparatus further includes a conveyor roller (disposed downstream of the sheet feed roller in a recording sheet conveying direction) configured to apply a conveying force on the recording sheet by rotating while contacting the recording sheet and a sheet position detection device that detects a position of the recording sheet fed from the sheet feed tray in a recording sheet conveying path extending between the sheet feed tray and the image forming device. The image forming apparatus may further includes a conveyor roller control device that controls a rotation amount of the conveyor roller in accordance with the position of the recording sheet detected by the sheet position detection device. In the image forming apparatus, the conveyor roller control device allows the rotation amount of the conveyor roller to increase when the recording sheet being conveyed is in contact with the sheet feed roller while also being in contact with the conveyor roller than a rotation amount of the conveyor roller when the recording sheet being conveyed is not in contact with the sheet feed roller while being in contact with the conveyor roller.

As described above, slippage of a recording sheet from the conveyor roller occurs when a load on the conveyor roller exceeds a load threshold where the conveyor roller and the sheet feed roller contact the recording sheet at the same time.

Therefore, according to the one aspect of the invention, the rotation amount of the conveyor roller is allowed to be greater when the recording sheet being conveyed is in contact with the sheet feed roller while being in contact with the conveyor roller than a rotation amount of the conveyor roller when the recording sheet being conveyed is not in contact with the sheet feed roller while being in contact with the conveyor roller. By doing so, a conveying amount reduced due to the slippage of the recording sheet from the conveyor roller can be complemented. Thus, the occurrence of banding due to the slippage of the recording sheet from the conveyor roller can be reduced.

In one conventional example, the rotation amount of the conveyor roller is corrected in accordance with the position of the recording sheet in the conveying path, that is, regardless of whether the recording sheet is in contact with the sheet feed roller while being conveyed is in contact with the conveyor roller. Therefore, the occurrence of banding due to the slippage of the recording sheet from the conveyor roller cannot be reduced.

The slippage of the recording sheet from the conveyor roller becomes greater as the conveying load of the conveyor roller increases. Therefore, according to another aspect of the invention, the rotation amount of the conveyor roller may be allowed to be greater as the conveying load of the conveyor roller increases. By doing so, the conveying amount of the recording sheet can be further accurately controlled. Thus, the occurrence of banding due to the slippage of the recording sheet from the conveyor roller can be reduced. In one example, the conveying load of the conveyor roller may be determined using a conveying load detection device.

According to another aspect of the invention, the conveying path may be substantially U-shaped. When the recording sheet is conveyed in the substantially U-shaped conveying path, the recording sheet is initially conveyed while contacting an outer guide member. As the conveyance of the recording sheet further proceeds, the state of the recording sheet is gradually changed from the above state to the state where the recording sheet is conveyed in contact with an inner guide member.

While the recording sheet is in contact with the inner guide member, tension acting on the recording sheet in the conveying direction increases as compared with a situation where the recording sheet is in contact with the outer guide member. In addition, friction at a contact surface between the recording sheet and the inner guide member is greater than friction at a contact surface between the recording sheet and the outer guide member.

According to another aspect of the invention, the rotation amount of the conveyor roller may be allowed to be greater in accordance with the position of the recording sheet in the sheet conveying path. That is, when the recording sheet is in contact with the sheet feed roller while being in contact with the conveyor roller, the rotation amount of the conveyor roller may be less when the recording sheet is in contact with the outer guide member than when the recording sheet is in contact with the inner guide member. By doing so, the conveying amount of the recording sheet can be further accurately controlled.

According to another aspect of the invention, the image forming apparatus may further include a large sheet feed tray that is disposed under the sheet feed tray and configured to being loaded with a recording sheet that is larger than a recording sheet that can be loaded in the sheet feed tray. A curvature of the conveying path from the sheet feed tray to the image forming device can be greater than a curvature of the conveying path from the large sheet feed tray to the image forming device. Therefore, a conveying resistance when a recording sheet is fed from the sheet feed tray is greater than a conveying resistance when a recording sheet is fed from the large sheet feed tray.

According to another aspect of the invention, the rotation amount of the conveyor roller may be allowed to be greater while the recording sheet is in contact with the sheet feed roller (i.e., when the conveying resistance is large) than the rotation amount of the conveyor roller while the recording sheet is not in contact with the sheet feed roller, when the recording sheet is fed from the sheet feed tray. By doing so, the conveying amount of the recording sheet can be further accurately controlled.

BRIEF DESCRIPTION OF THE DRAWINGS

Illustrative aspects of the invention will be described in detail with reference to the following figures in which like elements are labeled with like numbers and in which.

DETAILED DESCRIPTION

In illustrative embodiments of the invention, an image forming apparatus of the invention is applied to a multifunctional machine having several functions, such as a printing function, a scanning function, a color copying function, and a facsimile function. The illustrative embodiments of the invention will be described in detail with reference to the accompanying drawings.

It is noted that various connections are set forth between elements in the following description. It is noted that these connections in general and, unless specified otherwise, may be direct or indirect and that this specification is not intended to be limiting in this respect.

Figure 1:
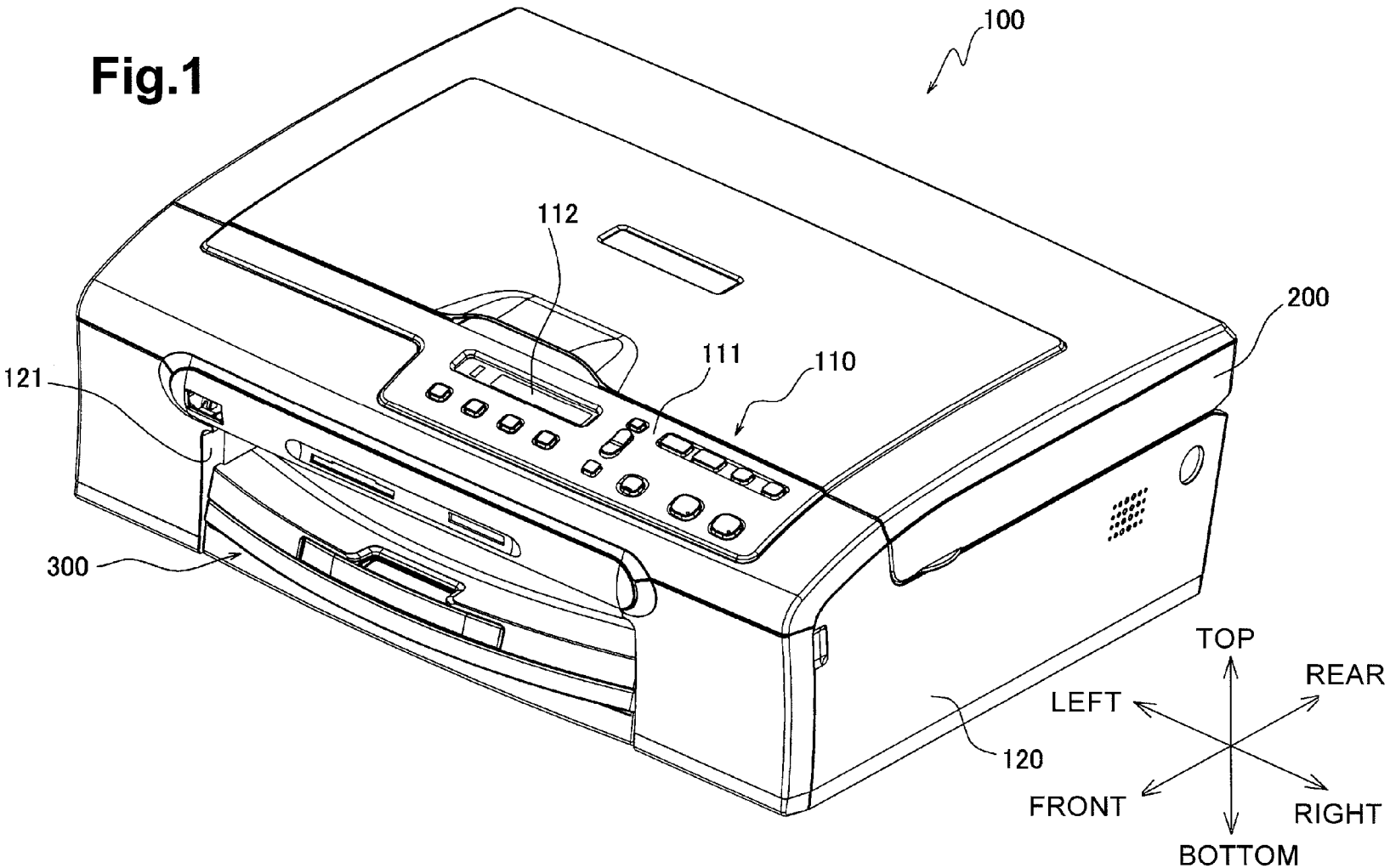
FIG. 1 is a perspective view of an image forming apparatus according to a first illustrative embodiment of the invention.

A general outline of an image forming apparatus 1 will be described below. As shown in FIG. 1, the image forming apparatus 100 of a first illustrative embodiment of the invention is installed such that the near side in FIG. 1 is referred to as the front side of the image forming apparatus 100, and the top side in FIG. 1 is referred to as the top side of the image forming apparatus 100 in a direction of gravity. With reference to those directions, other directions are determined. The image forming apparatus 100 includes a body casing 120 that constitutes its main body. The body casing 120 includes an operating panel 110 on its upper front. The operating panel 110 includes an operating part 111 and a display part 112. In the operating part 111, various operating buttons for input are arranged. The display part 112 displays messages and information such as images for a user.

The image forming apparatus 100 includes a scanner unit 200 that reads an image recorded on a document. The scanner unit 200 is disposed at the top of the body casing 120 and at the rear of the operating panel 110. The scanner unit 200 functions as an image reading device when a scanning function, a color copying function, or a facsimile function is used. The scanner unit 200 has a well-known structure with an image pickup device, such as a charge-coupled device (CCD) or a contact image sensor (CIS). Thus, a detailed description for the scanner unit 200 will be omitted.

A sheet feed tray 300 is provided at a lower part of the body casing 120. The sheet feed tray 300 is configured to be loaded with or accommodate therein a sheet-type recording medium, such as a recording sheet or an overhead transparency. The body casing 120 has an opening 121 in its front. When the sheet feed tray 300 is drawn in a horizontal direction toward the front through the opening 121, the sheet feed tray 300 can be partially or entirely removed from the body casing 120. When the sheet feed tray 300 is inserted into the body casing 120 in the horizontal direction toward the rear through the opening 121 of the body casing 120 while disengaged from the body casing 120, the sheet feed tray 300 can be attached into the body casing 120.

Figure 2:
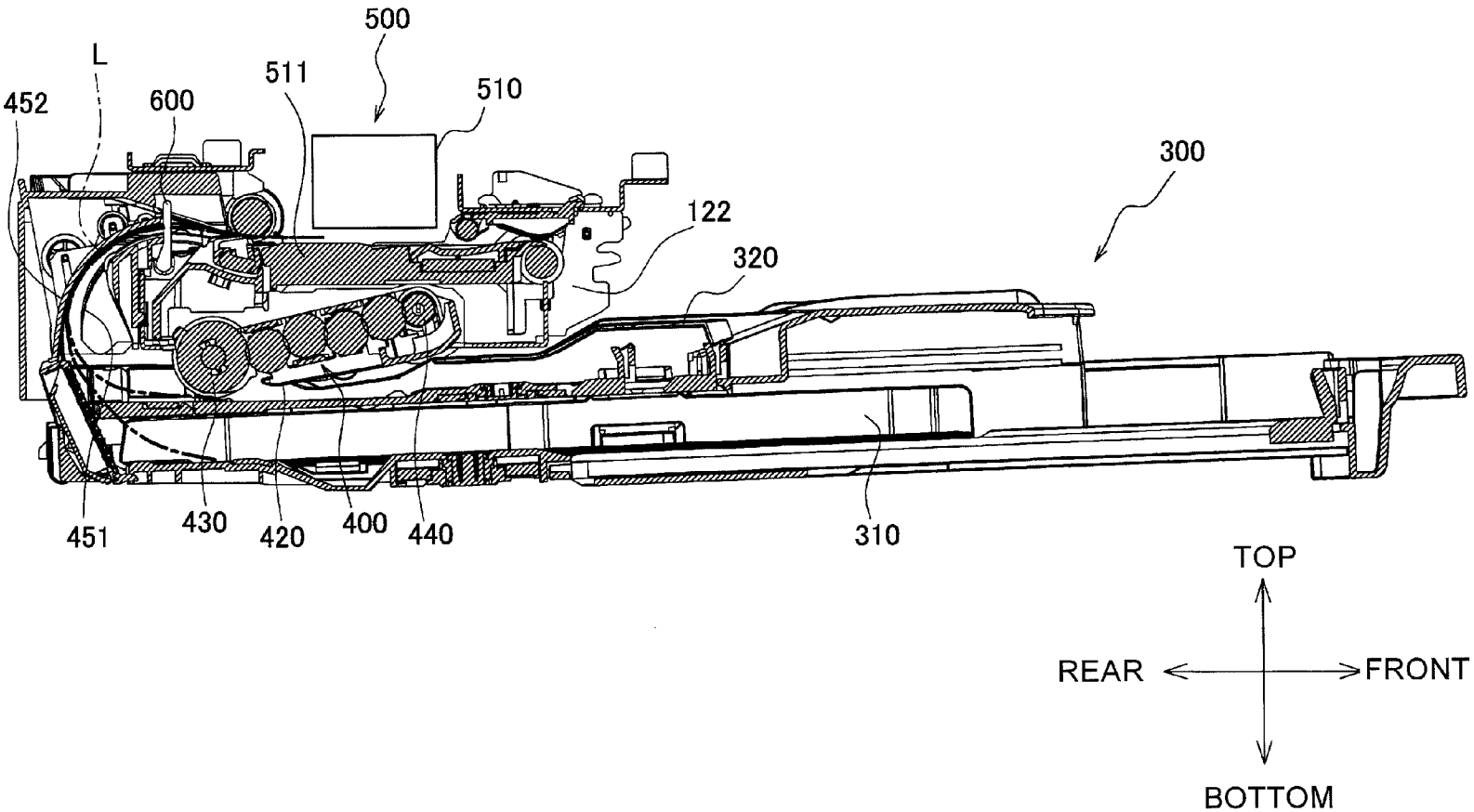
FIG. 2 is a side sectional view of a sheet feeding unit and an image forming unit.

As shown in FIG. 2, a sheet feeding unit 400 is provided in the body casing 120 at a portion above the sheet feed tray 300. The sheet feeding unit 400 is supported by a frame 122 fixed to the body casing 120. The sheet feeding unit 400 is a conveyor mechanism that is configured to feed or convey, one by one, a recording sheet loaded in the sheet feed tray 300, to an image forming unit 500.

A substantially U-shaped conveying path L is provided in the rear part of the body casing 120, i.e., at a portion corresponding to a rear end of the sheet feed tray 300. With this structure, a recording sheet being conveyed toward the rear from the sheet feed tray 300 is upwardly U-turned so as to be made a substantially 180-degree turn in the conveying path L thereby changing the conveying direction of the recording sheet to the frontward direction.

The conveying path L is defined by an inner guide member 451 and an outer guide member 452, which are disposed at an inner side and an outer side with respect to the conveying path L in the front-rear direction, respectively, to guide a recording sheet.

The image forming unit 500 is disposed above the sheet feed tray 300. The image forming unit 500 is configured to form or print an image on a recording sheet conveyed through the conveying path L. The recording sheet on which the image has been formed by the image forming unit 500 is ejected onto a forward part of an upper surface of the sheet feed tray 300.

Figure 5:
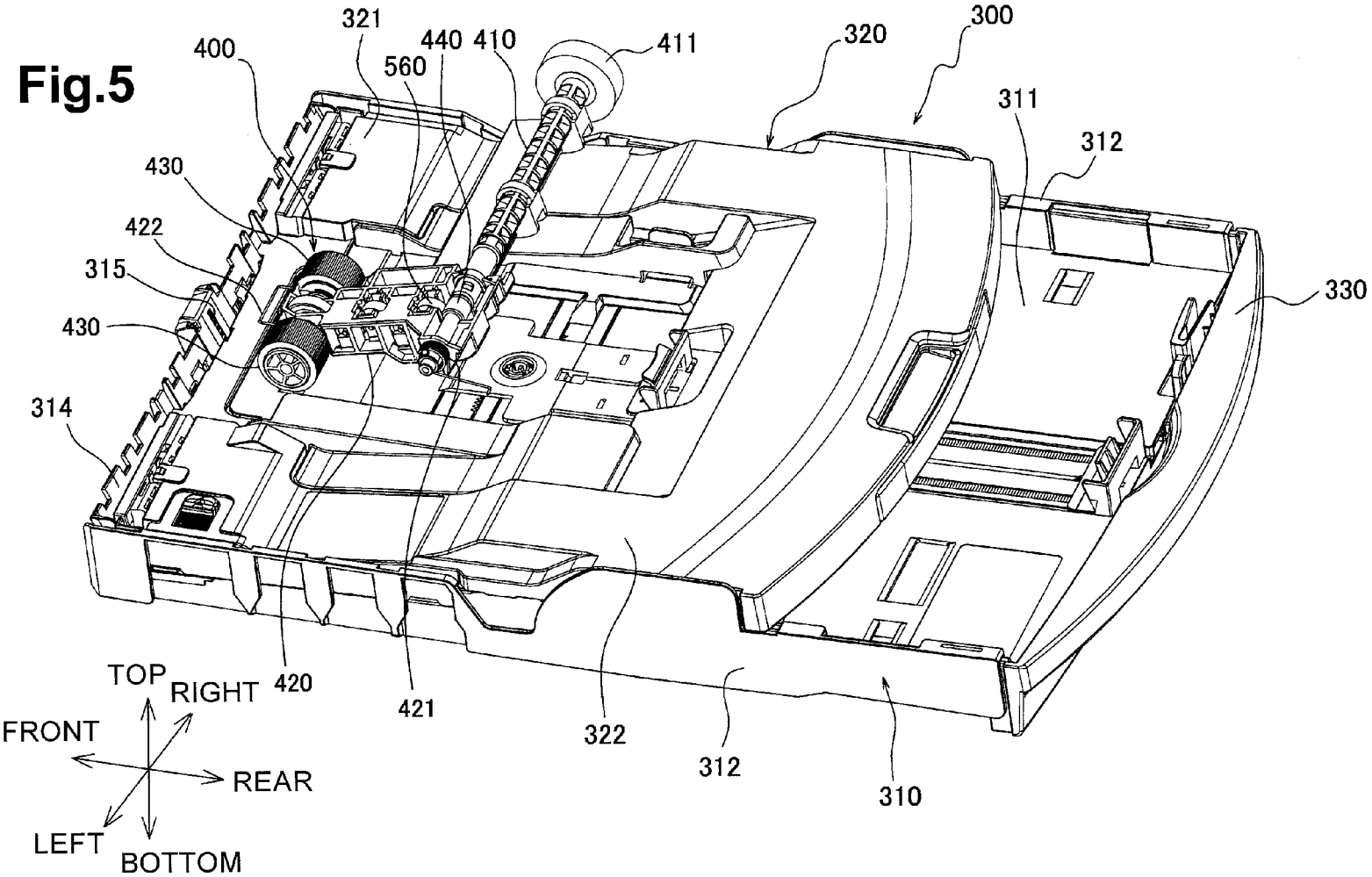
FIG. 5 is a perspective view showing a positional relationship between a second sheet feed tray and the sheet feeding unit.

The sheet feed tray 300 is configured to be loaded with or accommodate therein a recording sheet to be supplied to the image forming unit 500, as shown in FIG. 5.

The sheet feed tray 300 includes a first sheet feed tray 310, a second sheet feed tray 320, and a movable tray 330. The first sheet feed tray 310 has a box shape with an open-top structure. The second sheet feed tray 320 is disposed so as to cover the upper open area of the first sheet feed tray 310. The movable tray 330 is provided so as to be movable in an attaching/detaching direction of the sheet feed tray 300 (i.e., in the front-rear direction in the embodiment) with respect to the first sheet feed tray 310. The movable tray 330 and second sheet feed tray 320 are detachable from first sheet feed tray 310.

Figure 4:
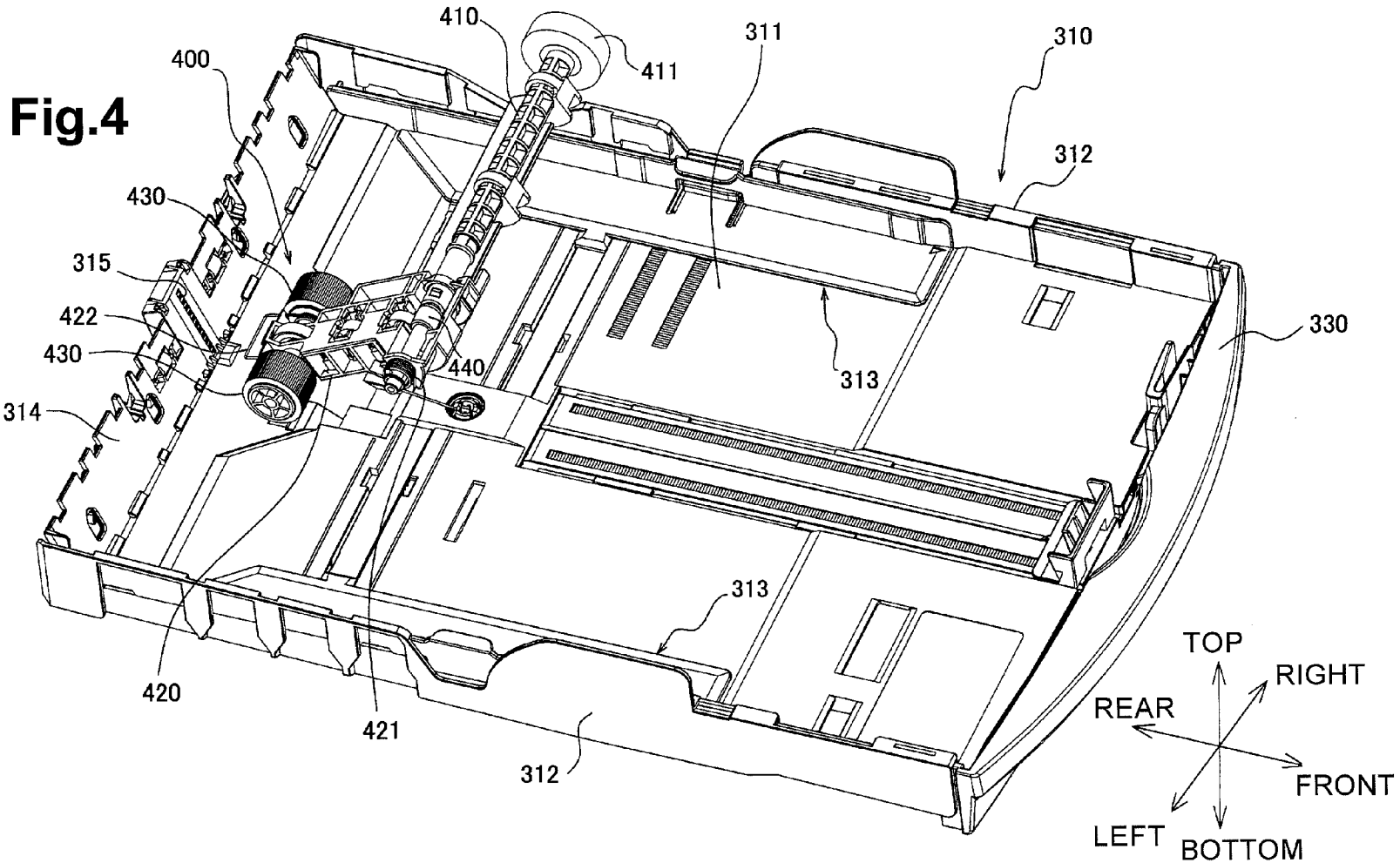
FIG. 4 is a perspective view showing a positional relationship between a first sheet feed tray and the sheet feeding unit.

As shown in FIG. 4, the first sheet feed tray 310 is a rectangular thin tray-like member in which a plurality of recording sheets can be loaded. In a first state where the movable tray 330 is retracted in the first sheet feed tray 310, the first sheet feed tray 310 can accommodate an A4-sized recording sheet at a maximum. When the movable tray 330 is extracted toward the front from the first sheet feed tray 310, the first sheet feed tray 310 can be configured to accommodate a legal-sized recording sheet therein.

The first sheet feed tray 310 includes a bottom plate 311 and side wall portions 312. The side wall portions 312 are provided at both ends of the first sheet feed tray 310 in the horizontal direction perpendicular to the attaching/detaching direction of the sheet feed tray 300 (in a left-right direction in the embodiment). The side wall portions 312 protrude from both ends of the first sheet feed tray in a direction perpendicular to a direction that the bottom plate 311 extends and extends in the attaching/detaching direction of the sheet feed tray 300 (e.g., rear-front in the illustrated embodiment).

A pair of guide members 313 is provided at the left and right ends of the bottom plate 311 so as to be movable in the left and right directions. The pair of guide members 313 moves in synchronization with each other such that a central position between the guide members 313 always exists at the same position (e.g., at a central position of the sheet feed tray 300 in the left-right direction) regardless of the positions of the guide members 313.

A guide plate 314 is provided at a downstream end of the first sheet feed tray 310 in the recording sheet conveying direction, that is, at the rear end of the first sheet feed tray 310. The guide plate 314 is configured to change the conveying direction of the recording sheet, on which a conveying force is being applied by the sheet feeding unit 400, to an upward direction. The guide plate 314 is provided with a metal separation member 315 at a middle portion thereof in the left-right direction.

The separation member 315 includes projections, which are aligned in the top-bottom direction at regular intervals. Tips of the projections slightly project from a front surface of the guide plate 314. With this structure, leading edges of several recording sheets pushed toward the guide plate 314 by the sheet feeding unit 400 receive conveying resistance by contacting the separation member 315 (the tips of the projections). Thus, a topmost recording sheet is separated and supplied, one by one, from a stack of recording sheets, toward the image forming unit 500.

The second sheet feed tray 320 is configured to be loaded with or accommodate therein a recording sheet, which is smaller than the recording sheet to be loaded in the first sheet feed tray 310, such as a postcard or an envelope.

The second sheet feed tray 320 includes a support member 321 and a second sheet feed tray body 322, as shown in FIG. 5. The support member 321 extends in the right-left direction to bridge the side wall portions 312 of the first sheet feeding tray 310 while being movable in the attaching/detaching direction of the sheet feed tray 300 (in the front-rear direction). The second sheet feed tray body 322 is connected to the support member 321 via a hinge mechanism (not shown) so as to be movable with respect to the support member 321.

The sheet feeding unit 400 functions as a conveyor mechanism that applies a conveying force on a recording sheet placed on the first sheet feed tray 310 or the second sheet feed tray 320 (the sheet feed tray 300) and supplies or conveys the recording sheet toward the image forming unit 500. As shown in FIG. 5, the sheet feeding unit 400 is rotatably supported by a support shaft 410. The support shaft 410 extends from the middle portion of the sheet feed tray 300 (in a left-right direction) toward one end (a right end in this embodiment) of the sheet feed tray 300 in the left-right direction above the sheet feed tray 300.

The support shaft 410 is supported by the metal frame 122 (FIG. 2). A first component of an external force acting on the support shaft 410 is mostly received by the frame 122. The support shaft 410 mainly transfers or receives a torque component of the eternal force acting on the support shaft 410.

One end of the support shaft 410 in its axial direction is provided with a large gear 411 at a portion corresponding to the one end (e.g., the right end) of the sheet feed tray 300 in the left-right direction. The large gear 411 transfers a rotational force to the support shaft 410 from a drive source (not shown). The other end of the support shaft 410 in its axial direction is provided with a small gear 440 at a portion corresponding to the middle portion of the sheet feed tray 300 in the left-right direction. The small gear 440 is configured to integrally rotate with the support shaft 410.

A roller arm 420 is an arm member that is rotatably connected to the support shaft 410 and extends in a radial direction of the support shaft 410. The roller arm 420 is provided with sheet feed rollers 430 at a distal end opposite an end connected to the support shaft 410. The sheet feed rollers 430 rotate about a rotational axis extending in a direction parallel to the axis of the support shaft 410.

The sheet feed rollers 430 apply conveying forces on a recording sheet by rotating while contacting the recording sheet placed in the sheet feed tray 300. When the roller arm 420 rotates toward the bottom plate 311 (i.e., toward the recording sheet) about the support shaft 410, the sheet feed rollers 430 are pressed against the recording sheet. The rotation of sheet feed rollers 430 then conveys the recording sheet toward the image forming unit 500.

Figure 6:
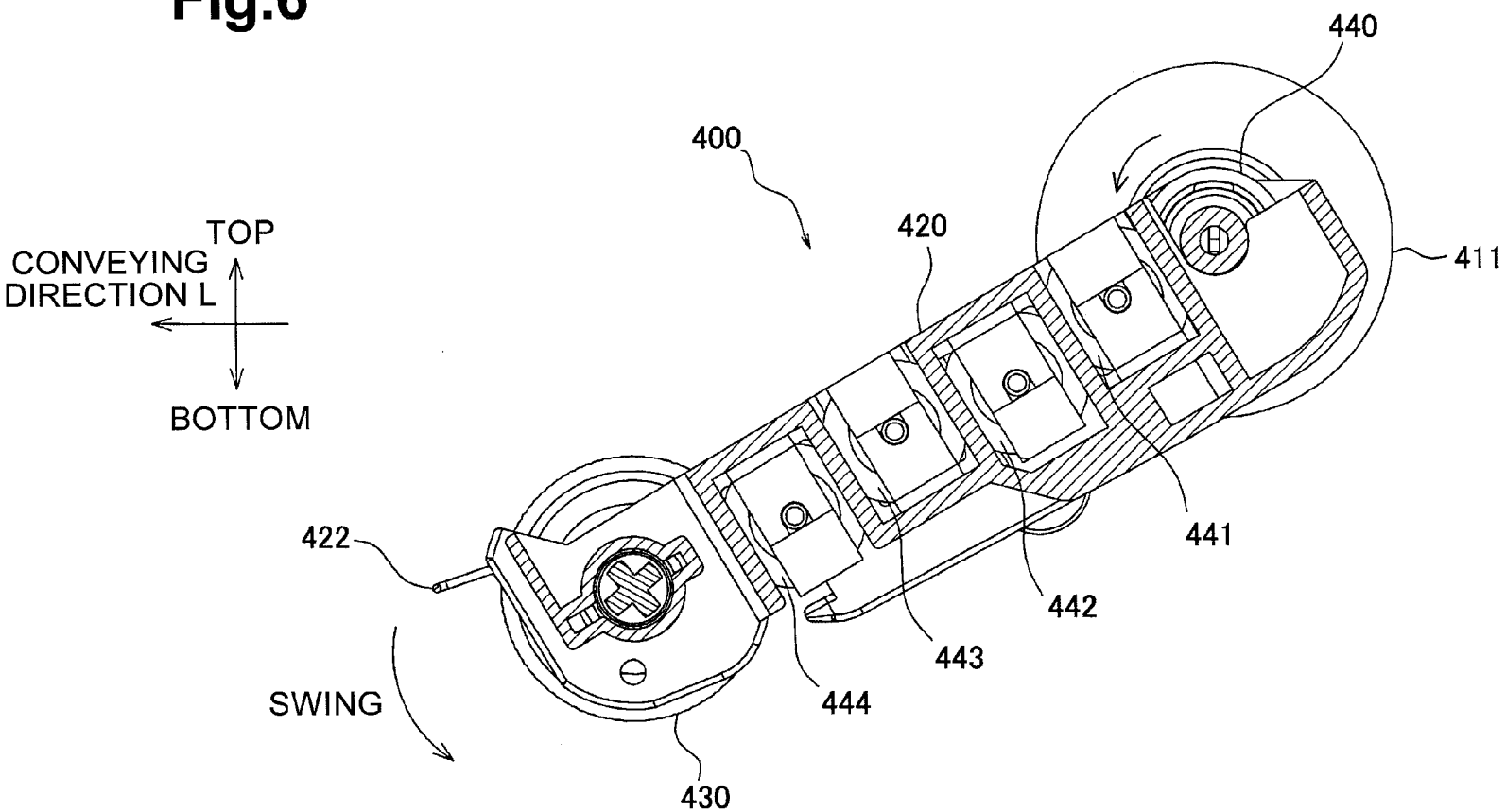
FIG. 6 is a sectional view of the sheet feeding unit.

As shown in FIG. 6, the roller arm 420 includes power transmission gears 441-444 to transfer a drive force from the small gear 440 to the sheet feed rollers 430. The power transmission gears 441-444 are aligned in a direction in which the roller arm 420 extends.

The support shaft 410 is disposed on the roller arm 420 at a position upstream of a contact point between the sheet feed rollers 430 and the recording sheet in the recording sheet conveying direction. The number of power transmission gears 441-444 included in the roller arm 420 is determined such that the support shaft 410 (and the small gear 440) and the sheet feed rollers 430 may rotate in directions opposite to one another.

With this structure, when the support shaft 410 (and the small gear 440) rotates in a counter-clockwise direction (as illustrated in FIG. 5), the roller arm 420 tends to swing toward the recording sheet due to a reaction force acting on the power transmission gear 441 while the sheet feed rollers 430 are forcefully pressed against the recording sheet by trying to move toward the upstream with respect to the recording sheet in the conveying direction. Therefore, even if a drive force acts on the sheet feed rollers 430, the sheet feed rollers 430 do not separate from the recording sheet. Thus, the conveying force is stably applied on the recording sheet by the sheet feed rollers 430.

As described above, in the manner in which the sheet feed rollers 430 are pressed against the recording sheet by using the reaction force of the drive force for rotating the sheet feed rollers 430, an initial pressing force tends to vary at the time when the sheet feed rollers 340 begins contacting the recording sheet. In particular, the pressing force is not produced when the drive force does not act on the sheet feed rollers 430.

As shown in FIG. 5, the support shaft 410 includes a first torsion coil spring 421, which produces an elastic force that swings the roller arm 420 toward the recording sheet. The roller arm 420 may also include a second torsion coil spring 422 at its tip portion. The second torsion coil spring 422 produces an elastic force that also swings the roller arm 420 toward the recording sheet.

When an angle between the roller arm 420 and a recording sheet placed in the sheet feed tray 300 is small (e.g., when the roller arm 420 swings in a direction opposite to the direction of the recording sheet and when the second torsion coil spring 422 contacts a contact piece 123, the roller arm 420 extends substantially in the horizontal direction), the second torsion coil spring 422 is elastically deformed by a force resulting from contact with the contact piece 123, connected to the frame 122. Thus, the second torsion coil spring 422 urges the roller arm 420 toward the recording sheet, as shown in FIGS. 7B and 7C. A dash-dot line in FIGS. 7B and 7C represents a level of the topmost recording sheet in the stack loaded in the sheet feed tray 300.

Figure 7A:
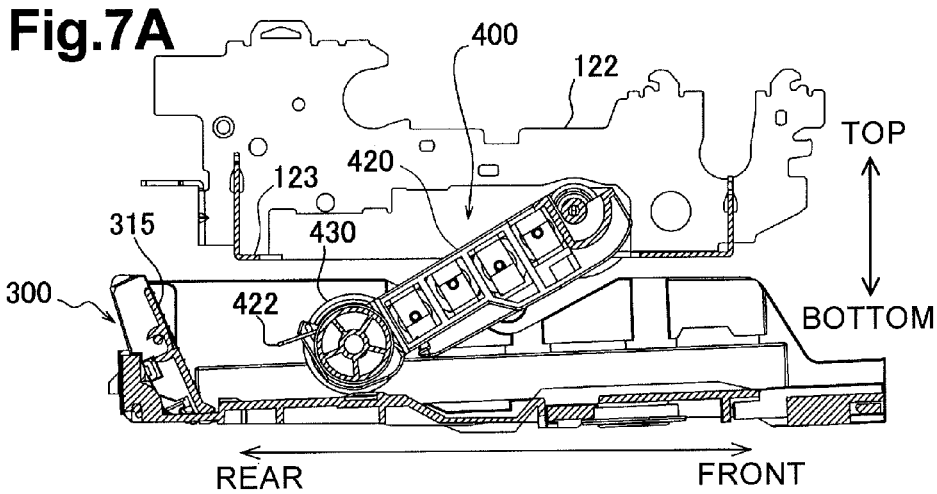
FIGS. 7A to 7C are diagrams each showing action of a second torsion coil spring.
Figure 7B:
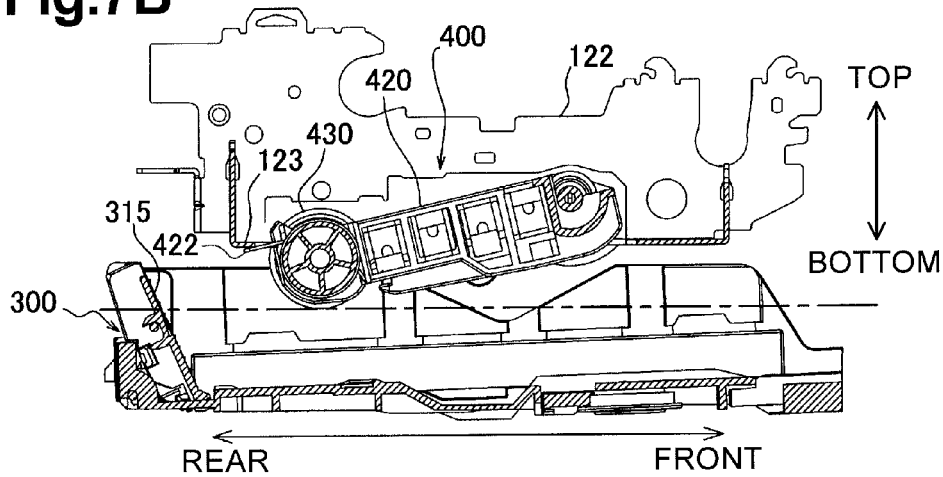
Figure 7C:
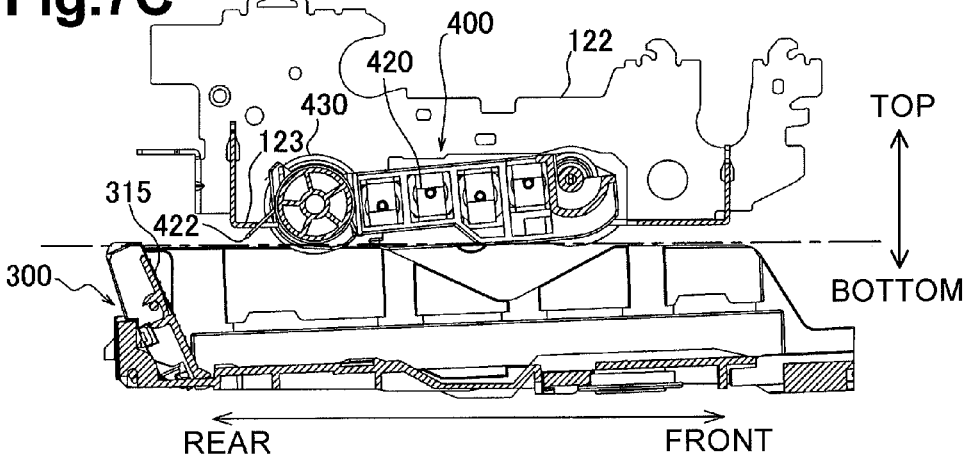

When the angle between the roller arm 420 and the recording sheet placed in the sheet feed tray 300 is large (e.g., when the angle is substantially equal to an angle between the roller arm 420 and a bottom of the sheet feed tray 300 when the sheet feed rollers 430 is in contact with the bottom of the sheet feed tray 300), the second torsion coil spring 422 is separated from the contact piece 123, as shown in FIG. 7A. Thus, the elastic force that presses the roller arm 420 toward the recording sheet does not exist. That is, the second torsion coil spring 422 urges the roller arm 420 toward the recording sheet only when the roller arm 420 extends substantially in the horizontal direction.

The image forming unit 500 is a well-known inkjet-type image forming unit that ejects fine ink droplets onto a recording sheet.

Figure 3:
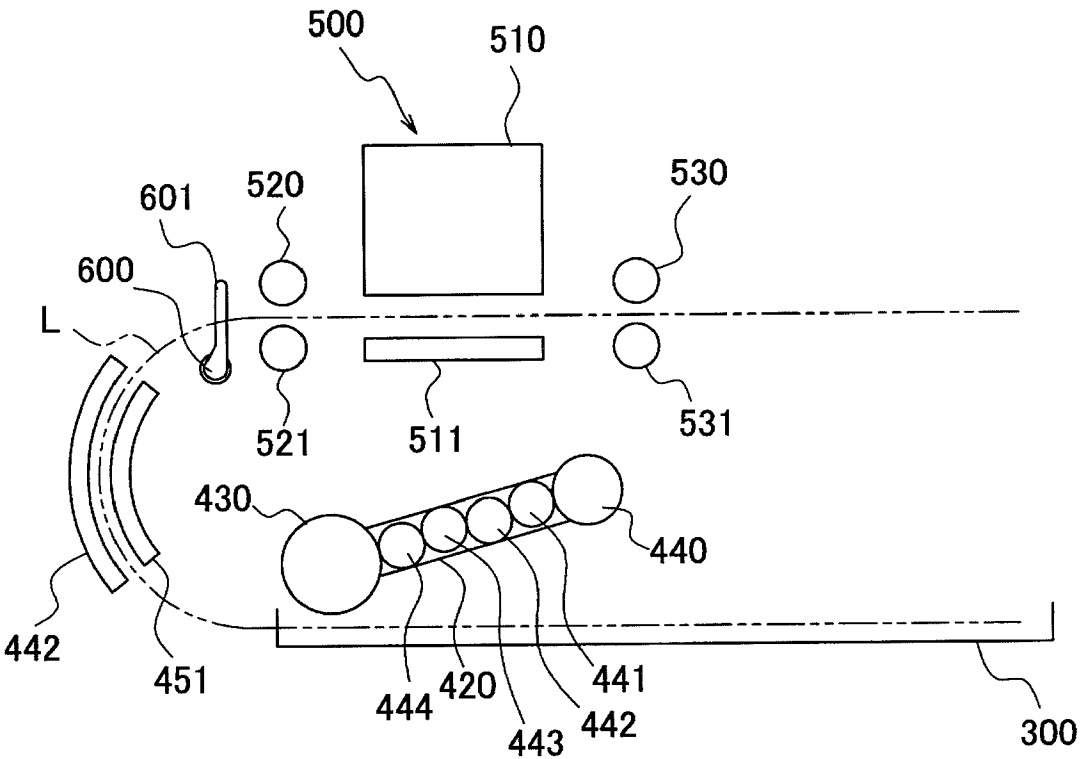
FIG. 3 is a diagram of the recording sheet conveying path and associated structures corresponding to FIG. 2.

As shown in FIG. 3, the image forming unit 500 includes a recording head unit 510 functioning as an image forming device. The recording head unit 510 ejects ink droplets onto a recording sheet to be conveyed onto a platen 511 while being scanned in a direction perpendicular to the recording sheet conveying direction (in a direction perpendicular to the drawing sheet of FIG. 3).

A conveyor (PF) roller 520 is provided at a position upstream of the platen 511 and downstream of the sheet feed rollers 430 in the conveying direction. The conveyor roller 520 further conveys a recording sheet supplied from the sheet feed rollers 430 onto the platen 511. The conveyor roller 520 applies a conveying force on the recording sheet by rotating while contacting the recording sheet.

A pressure roller 521 is disposed opposite to the conveyor roller 520 so as to press the recording sheet against the conveyor roller 520. The recording sheet is pinched between the conveyor roller 520 and the pressure roller 521 and is intermittently conveyed on the platen 511 by a predetermined line feed length. In accordance with the intermittent conveyance of the recording sheet, the recording head unit 510 is scanned by a line feed of the recording sheet (a parallel movement) and performs image formation from a leading edge of the recording sheet.

A sheet ejection roller 530 and a pressure roller 531 are provided downstream of the platen 511 in the conveying direction. The sheet ejection roller 530 conveys the recording sheet, on which the image formation has been completed, to a sheet output tray (not shown) by rotating in synchronization with the conveyor roller 520.

The sheet feed rollers 430, the conveyor roller 520, and the sheet ejection roller 530 rotate by obtaining power from an LF motor 703 (FIG. 8) through a power transmission mechanism (not shown) that may include gears and/or belts/chains and the like.

The power transmission mechanism is configured to allow the conveyor roller 520 and the sheet ejection roller 530 to rotate in a direction opposite of a normal direction (i.e., a direction in which a recording sheet is conveyed for image formation). The sheet feed rollers 430 rotate in the normal direction. In addition, the power transmission mechanism is configured to interrupt the transmission of the power to the sheet feed rollers 430 while the conveyor roller 520 and the sheet ejection roller 530 rotate in the normal direction.

In this embodiment, a one-way clutch that transmits power in one-direction is configured to transmit power along a power transmission path from the LF motor 703 to the sheet feed rollers 430 to implement the above operation.

A register sensor 600 is provided upstream of the conveyor roller 520 in the conveying direction. The register sensor 600 is configured to detect whether a leading edge of a recording sheet conveyed by the sheet feed rollers 430 in the conveying direction has passed through a predetermined position. The register sensor 600 may include a well-known sensor device such as a sensor actuator 601 that swings by contacting a recording sheet and/or a transmissive optical sensor (not shown).

Figure 8:
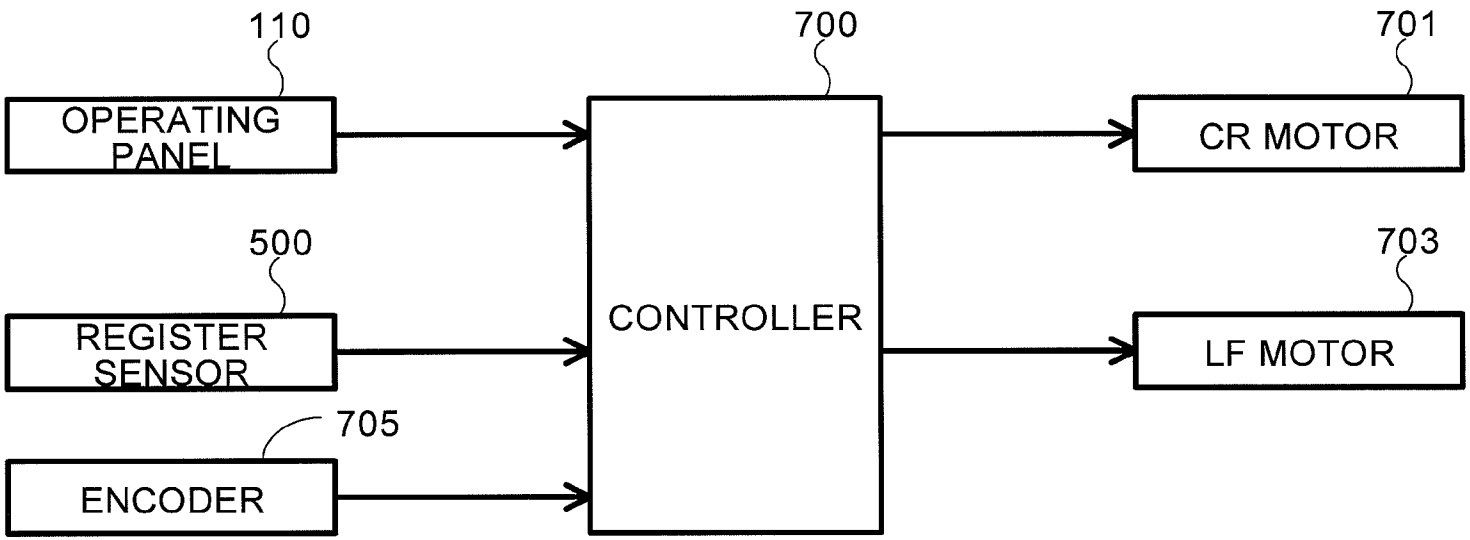
FIG. 8 is a block diagram showing a portion of a control system of the image forming apparatus.

Referring to FIG. 8, a portion of a control system of the image forming apparatus 100 will be described.

A CR (carriage) motor 701 may act as a power source for scanning the recording head unit 510. The LF (common drive) motor 703 may act as a power source for supplying a rotating force to the sheet feed rollers 430, the conveyor roller 520 and the sheet ejection roller 530. Rotation amounts (rotation angles) and rotating directions of the electric motors 701, 703 are controlled by a controller 700.

Controller 700 may be configured to receive a variety of signals including a setting signal sent from the operating panel 110, a signal sent from the register sensor 600 and a detection signal sent from an encoder 705 that detects the rotation amount (the rotation angle) of the conveyor roller 520.

A conveying operation of a recording sheet performed in the image forming apparatus 1 of this embodiment will be described with reference to FIGS. 9 and 10.

Figure 9:
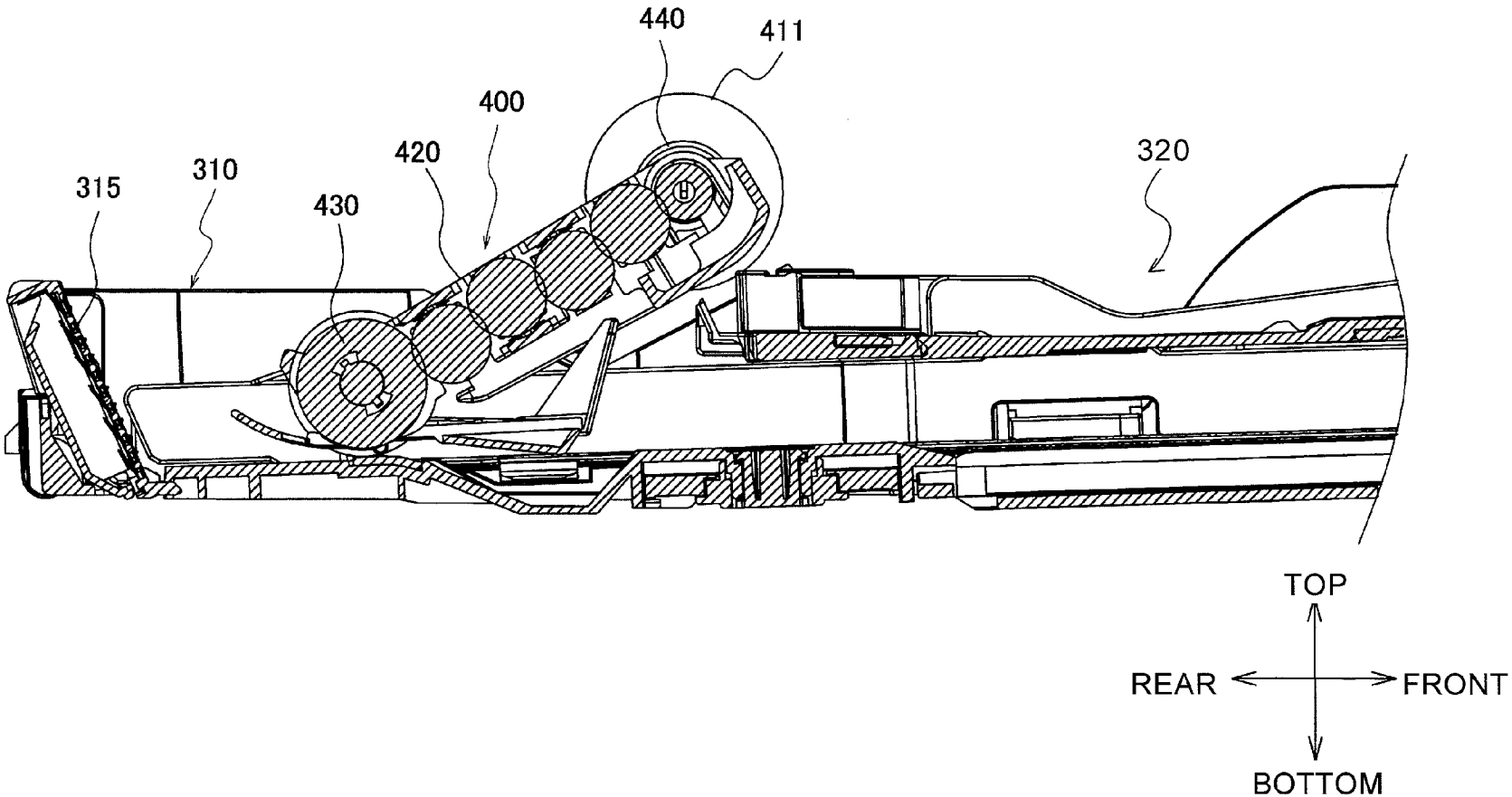
FIG. 9 is a side sectional view showing a state of a sheet feed roller when a recording sheet loaded in the first sheet feed tray is conveyed.

To feed a recording sheet loaded in the first sheet feed tray 310, as shown in FIG. 9, the second sheet feed tray 320 is moved toward the front of the image forming apparatus 100 to allow the sheet feed rollers 430 to contact the recording sheet placed in the first sheet feed tray 310. In this environment, when the sheet feed rollers 430 rotate, the recording sheet placed in the first sheet feed tray 310 is conveyed toward the platen 511 (and the image forming unit 500).

Figure 10:
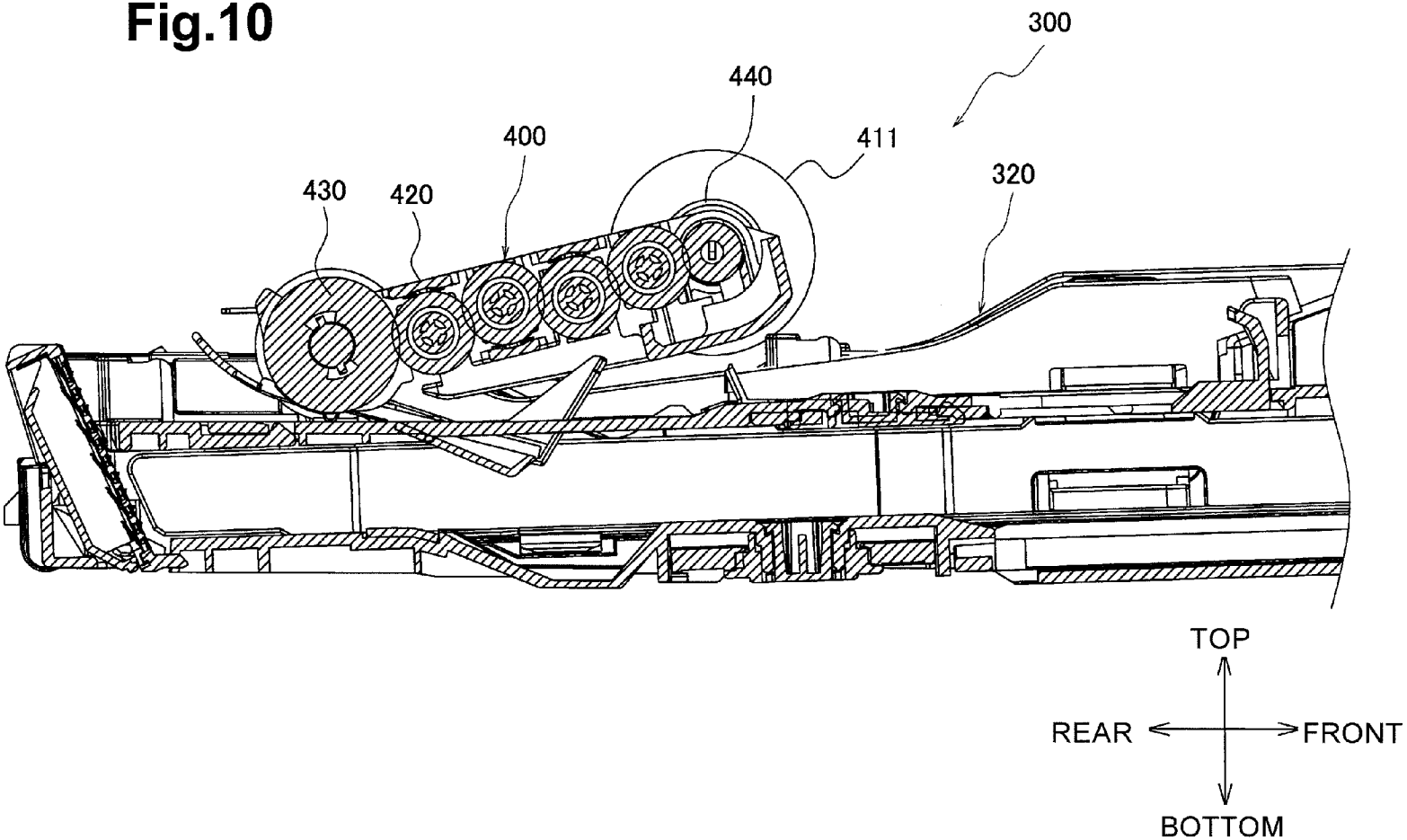
FIG. 10 is a side sectional view showing a state of a sheet feed roller when a recording sheet loaded in the second sheet feed tray is conveyed.

To feed a recording sheet loaded in the second sheet feed tray 320, as shown in FIG. 10, the second sheet feed tray 320 is moved toward the rear of the image forming apparatus 100 to allow the sheet feed rollers 430 to contact the recording sheet placed in the second sheet feed tray 320. In this environment, when the sheet feed rollers 430 rotate, the recording sheet placed in the second sheet feed tray 320 is conveyed toward the platen 511 (and the image forming unit 500).

Register sensor 600 detects a leading edge of the recording sheet supplied from the sheet feed tray 300. In response, a total rotating amount of the conveyor roller 520 is monitored. When the total rotation amount of the conveyor roller 520 reaches a predetermined rotation amount after the detection of the leading edge passing the register sensor 600, (e.g., when the leading edge of the recording sheet reaches the conveyor roller 520 and skewing of the recording sheet has been corrected), the rotating direction of the conveyor roller 520 and the sheet ejection roller 530 is changed to the normal direction from the reverse direction to interrupt the power transmission to the sheet feed rollers 430.

In so doing, the recording sheet begins being conveyed toward the image forming unit 500 by the conveying force of the conveyor roller 520. Power transmission gears 441-444 are included in the power transmission path from the LF motor 703 to the sheet feed rollers 430. Therefore, even if the power transmission to the sheet feed rollers 430 is interrupted, the conveyor roller 520 may still have a strong rotational resistance.

Because the recording sheet is conveyed while being pulled toward the sheet feed rollers 430, a conveying load on the conveyor roller 520 becomes larger. In addition, the second sheet feed tray 320 is positioned closer to the image forming unit 500 than the first sheet feed tray 310. Therefore, when a recording sheet is supplied from the second sheet feed tray 320, the recording sheet is conveyed while being more greatly warped as compared to a recording sheet supplied and conveyed from the first sheet feed tray 310.

Therefore, when a recording sheet placed on the second sheet feed tray 320 is conveyed, a larger conveying resistance occurs compared with a conveying resistance experienced when conveying a recording sheet placed on the first sheet feed tray 310. Accordingly, a recording sheet may slip from the conveyor roller 520 when the recording sheet placed on the second sheet feed tray 320 is conveyed (due to the relatively greater conveying resistance).

First, in a case where an image is to be formed on a recording sheet loaded in the second sheet feed tray 320, the controller 700 determines the position of the recording sheet being conveyed in the conveying path L in accordance with a point in time at which the register sensor 600 issues a signal indicating detection of the leading edge of the recording sheet. When the sheet supply rollers 430 and the conveyor roller 520 are both in contact with the recording sheets the controller 700 controls the LF motor 703 to allow the rotation amount of the conveyor roller 520 to be greater as compared with a state where the sheet supply rollers 430 are not in contact with the recording sheet while the conveyor roller 520 is in contact with the recording sheet.

The controller 700 determines whether an image is to be formed on a recording sheet loaded in the second sheet feed tray 320, in accordance with the settings of the operating panel 110.

Figure 11:
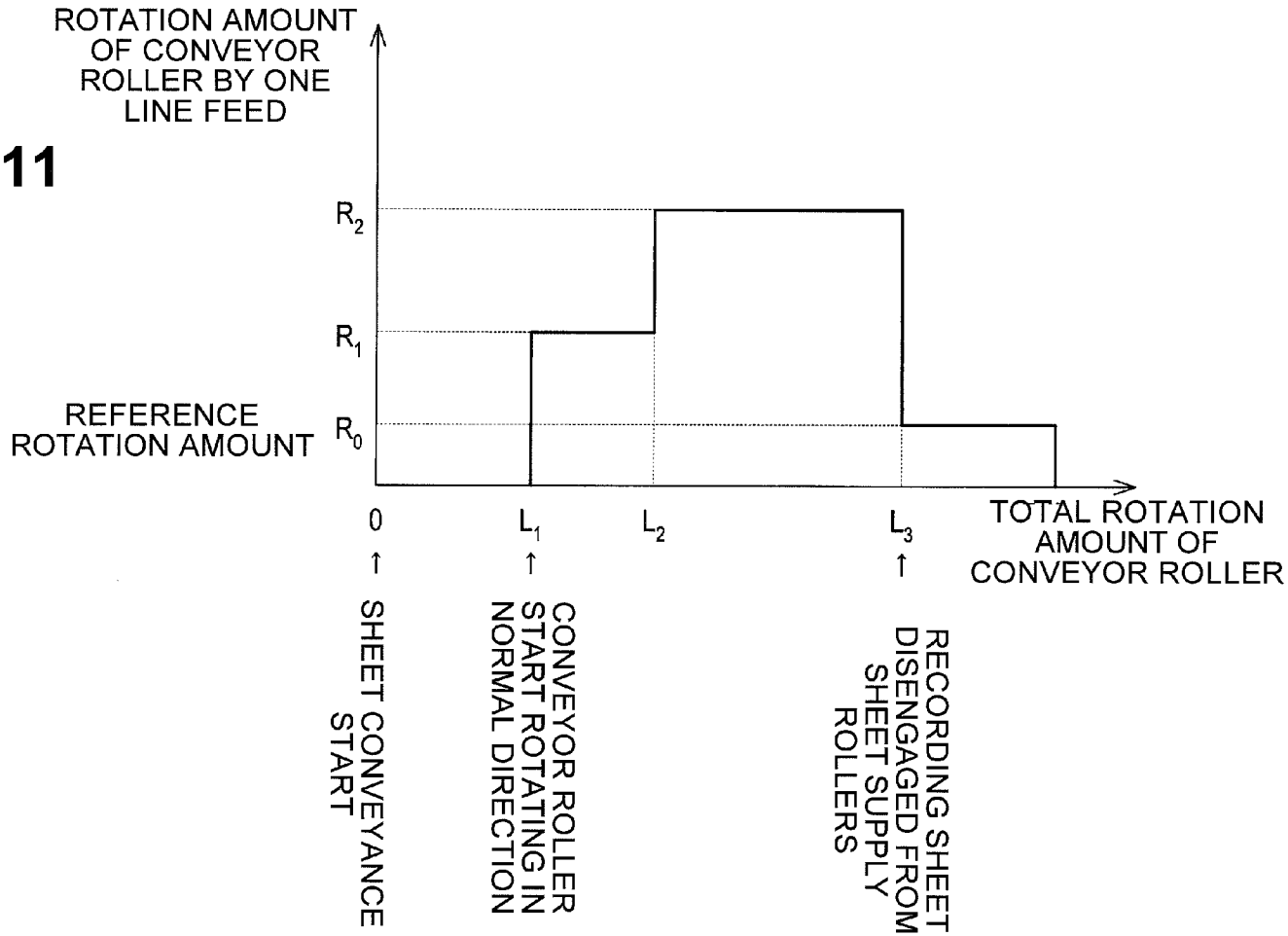
FIG. 11 is a chart showing a change in a rotation amount of a conveyor roller when a first type of sheet is used as a recording sheet.

In particular, as shown in FIG. 11, the controller 700 may correct the rotation amount of the conveyor roller 520 to a first rotation amount R1 that is greater than a reference rotation amount R0 when the total rotation amount of the conveyor roller 520 reaches a predetermined total rotation amount and after the register sensor 600 had detected the leading edge of the recording sheet. The reference rotation amount R0 is a rotation amount of the conveyor roller 520 that is adopted while the sheet feed rollers 430 are not in contact with the recording sheet and after the trailing edge of the recording sheet has disengaged from the sheet feed rollers 430.

After that, as the recording sheet is conveyed with its trailing edge contacting the sheet feed rollers 430, a tension (back tension) in the conveying direction acting on the recording sheet gradually increases. Thus, the controller 700 corrects the rotation amount of the conveyor roller 520 to a second rotation amount R2, which is greater than the first rotation amount R1, when the total rotation amount of the conveyor roller 520, determined after the rotation amount of the conveyor roller 520 has been changed to the first rotation amount R1, reaches a second predetermined total rotation amount.

Subsequently, the controller 700 changes the rotation amount of the conveyor roller 520 to the reference rotation amount R0, assuming that the trailing edge of the recording sheet has disengaged from the sheet feed rollers 430, when the total rotation amount of the conveyor roller 520 reaches a third predetermined total rotation amount of the conveyor roller 520 after the register sensor 600 has detected the leading edge of the recording sheet.

The controller 700 determines a resolution of an image to be formed and a type of a recording sheet to be used in accordance with the settings inputted through the operating panel 110 or by a computer connected with the image forming apparatus 100. The controller 700 controls the rotation of the conveyor roller 520 such that the correction amount of the rotation of the conveyor roller 520 becomes smaller with higher resolution of the image to be formed. When an image is to be formed on a slippery recording sheet (i.e., a recording sheet with a low friction surface), such as a calendared sheet or an inkjet recording sheet, the controller 700 controls the rotation of the conveyor roller 520 such that the correction amount of the rotation of the conveyor roller 520 is larger.

Figure 12A:
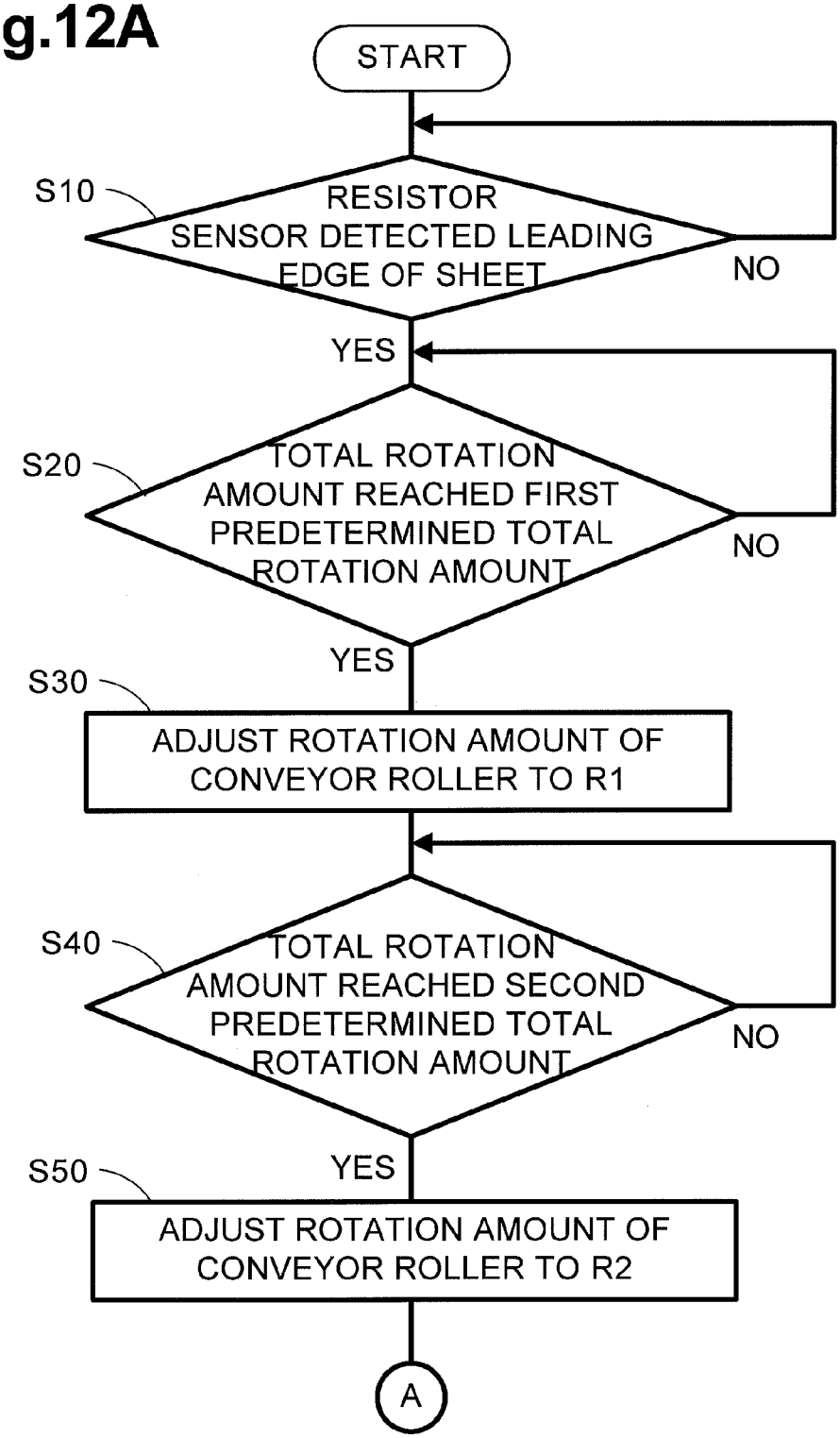
FIG. 12A is a flowchart showing a method for controlling a rotation amount.
Figure 12B:
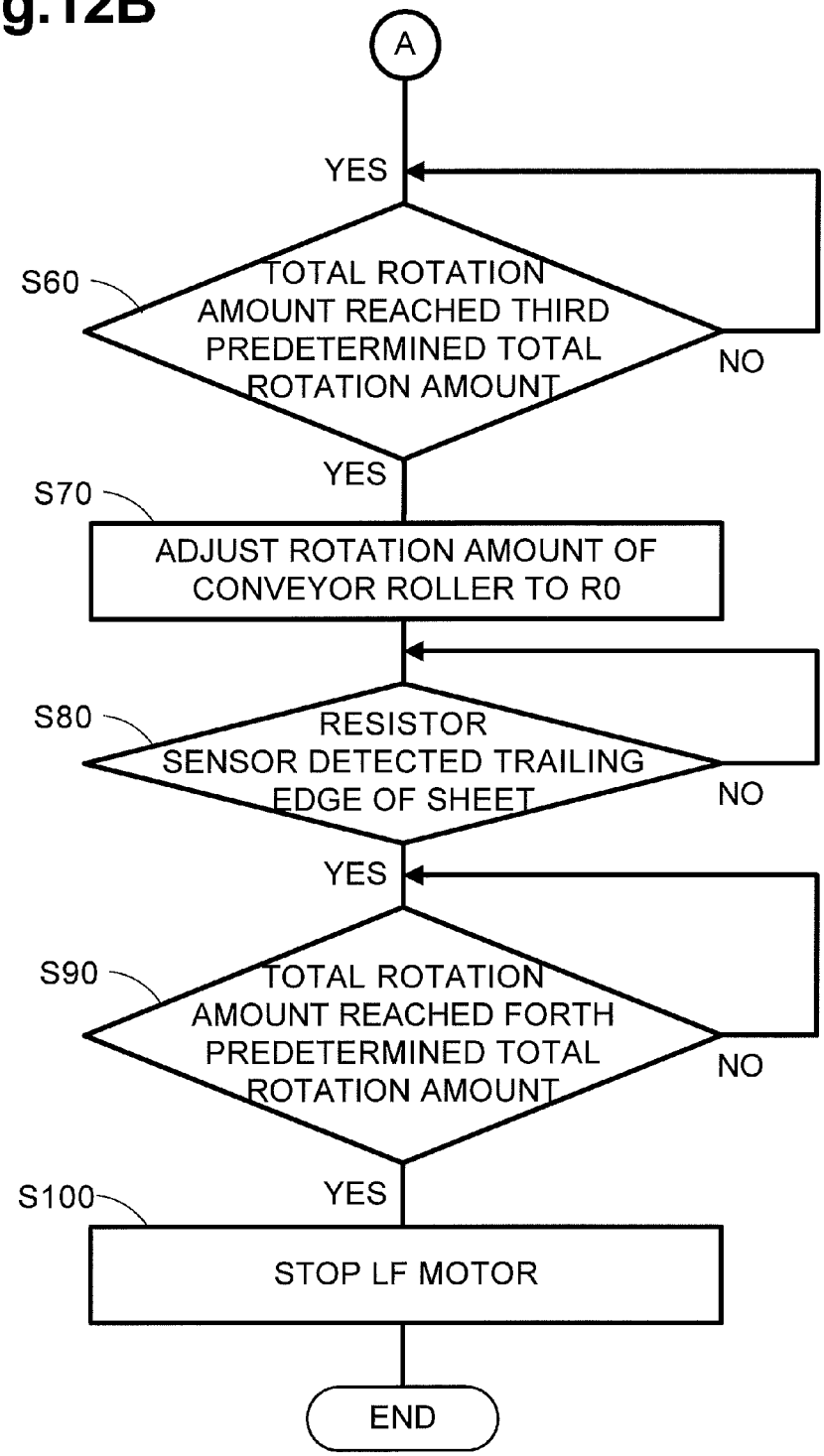
FIG. 12B is a flowchart continued from FIG. 12A.

Referring to FIGS. 12A and 12B, the functionality and configuration of the controller 700 will be described. First, the controller 700 may determine whether a leading edge of a recording sheet in the conveying direction has been detected by the register sensor 600 (Step 10, hereinafter, S stands for a step).

When the controller 700 determines that the leading edge of the recording sheet in the conveying direction has been detected by the register sensor 600 (S10:YES), the controller may further determine whether the total rotation amount of the conveyor roller 520 has reached a first predetermined total amount after the detection has been made (S20). When the total rotation amount is determined to have reached the first predetermined total amount (S20:YES), the controller 700 instructs the LF motor 703 to adjust the rotation amount of the conveyor roller 520 to the first rotation amount R1 (S30).

Then, a determination is made as to whether the total rotation amount of the conveyor roller 520, as determined after the LF motor 703 has adjusted the rotation amount of the conveyor roller 520 to the first rotation amount R1 (S40), has reached a second predetermined total rotation amount. Upon determining that the total rotation amount of the conveyor roller 520 has reached the second predetermined total rotation amount (S40:YES), the controller 700 instructs the LF motor 703 to adjust the rotation amount of the conveyor roller 520 to the second rotation amount R2 (S50).

Subsequently, a further determination is made as to whether the total rotation amount of the conveyor roller 520 has reached the third predetermined total rotation amount after a trailing edge of the recording sheet in the conveying direction has been detected by the register sensor 600 (S60). Upon determining that the total rotation amount of the conveyor roller 520 has reached a third predetermined total rotation amount (S60:NES), the controller 700 instructs the LF motor 703 to adjust the rotation amount of the conveyor roller 520 to the reference rotation amount R0 (S70).

Next, it is determined, e.g., by controller 700, whether the trailing edge of the recording sheet has been detected by the register sensor 600, i.e., whether the register sensor 600 has been turned to an off state from an on state (S80). Upon determining that the register sensor 600 has been turned to the off state (S80:YES), another determination is made as to whether the total rotation amount of the conveyor roller 520 has reached a fourth predetermined total rotation amount after the register sensor 600 had been turned to the off state (S90). When it is determined that the total rotation amount of the conveyor roller 520 has reached the fourth predetermined total rotation amount (S90:YES), the LF motor 703 stops, assuming that an image formation on the recording sheet has been completed (S100).

In the first illustrative embodiment, while the sheet supply rollers 430 are in contact with the recording sheet with the conveyor roller 520 also being in contact with the recording sheet, the controller 700 controls the LF motor 703 to adjust the rotation amount of the conveyor roller 520 to be greater than a rotation amount of the conveyor roller 520 in a state where the sheet supply rollers 430 are not in contact with the recording sheet but the conveyor roller 520 is in contact with the recording sheet. Thus, the conveying amount of the recording sheet reduced due to the slippage of the recording sheet can be compensated for. Accordingly, the conveying amount of the recording sheet can be more accurately controlled. Likewise, banding due to the slippage caused between the recording sheet and the conveyor roller 520 can also be reduced.

As described above, the slippage occurring between the conveyor roller 520 and the recording sheet tends to occur when a recording sheet loaded in the second sheet feed tray 320 is fed. Accordingly, the rotation amount of the conveyor roller 520 may be corrected as described above when the recording sheet loaded in the second sheet feed tray 320 is conveyed. Thus, the conveying amount of the recording sheet can be further accurately controlled.

In a first illustrative embodiment, the rotation amount of the conveyor roller 520 is corrected by two levels (the first rotation amount R1 and the second rotation amount R2). In a second illustrative embodiment, the rotation amount of the conveyor roller 520 is corrected by three levels (a first rotation amount R1, a second rotation amount R2 and a third rotation amount R3).

Figure 13:
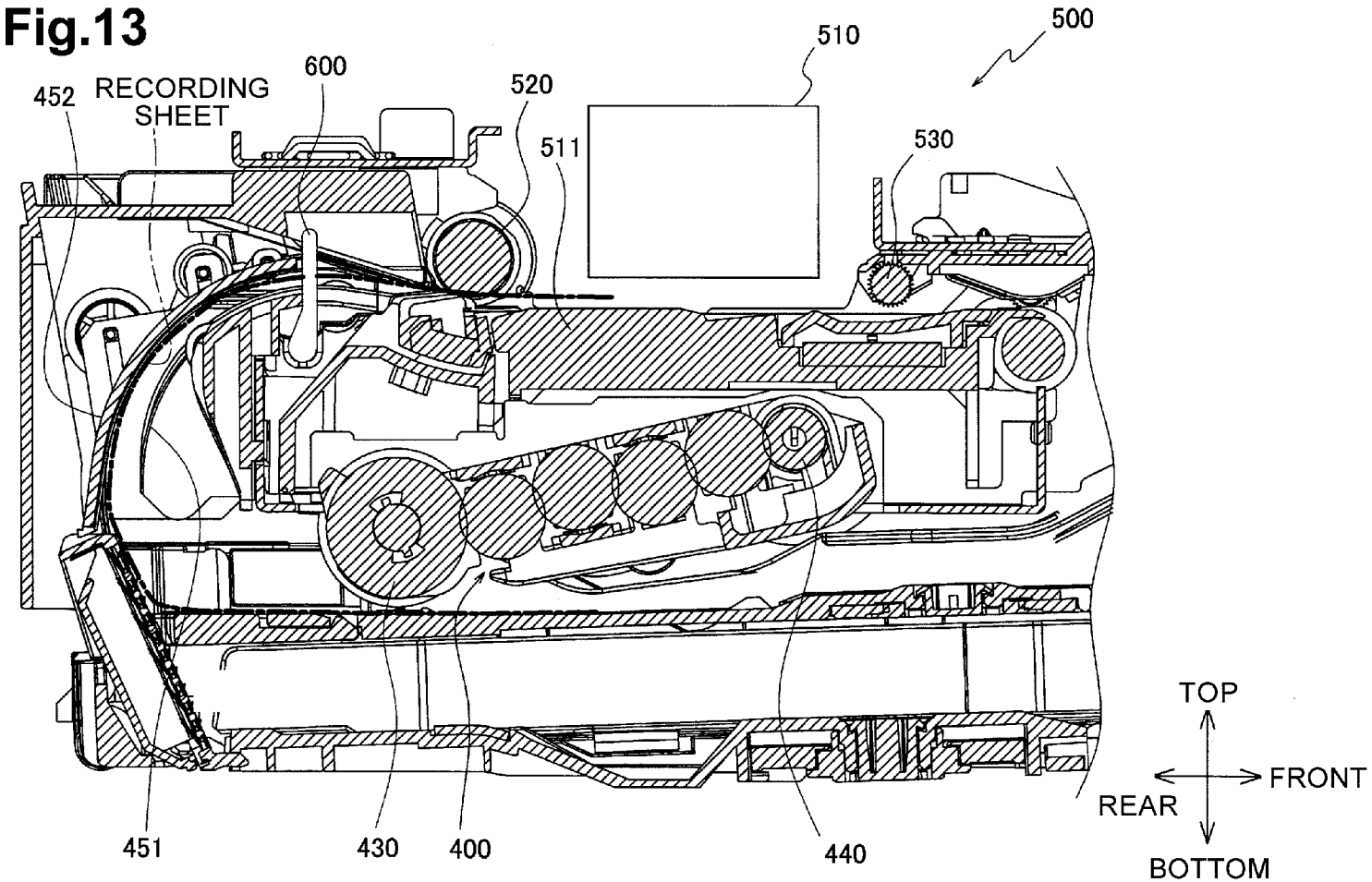
FIG. 13 shows an image forming apparatus in a state where a recording sheet loaded in the second sheet feed tray is being conveyed according to a second illustrative embodiment of the invention.
Figure 14:
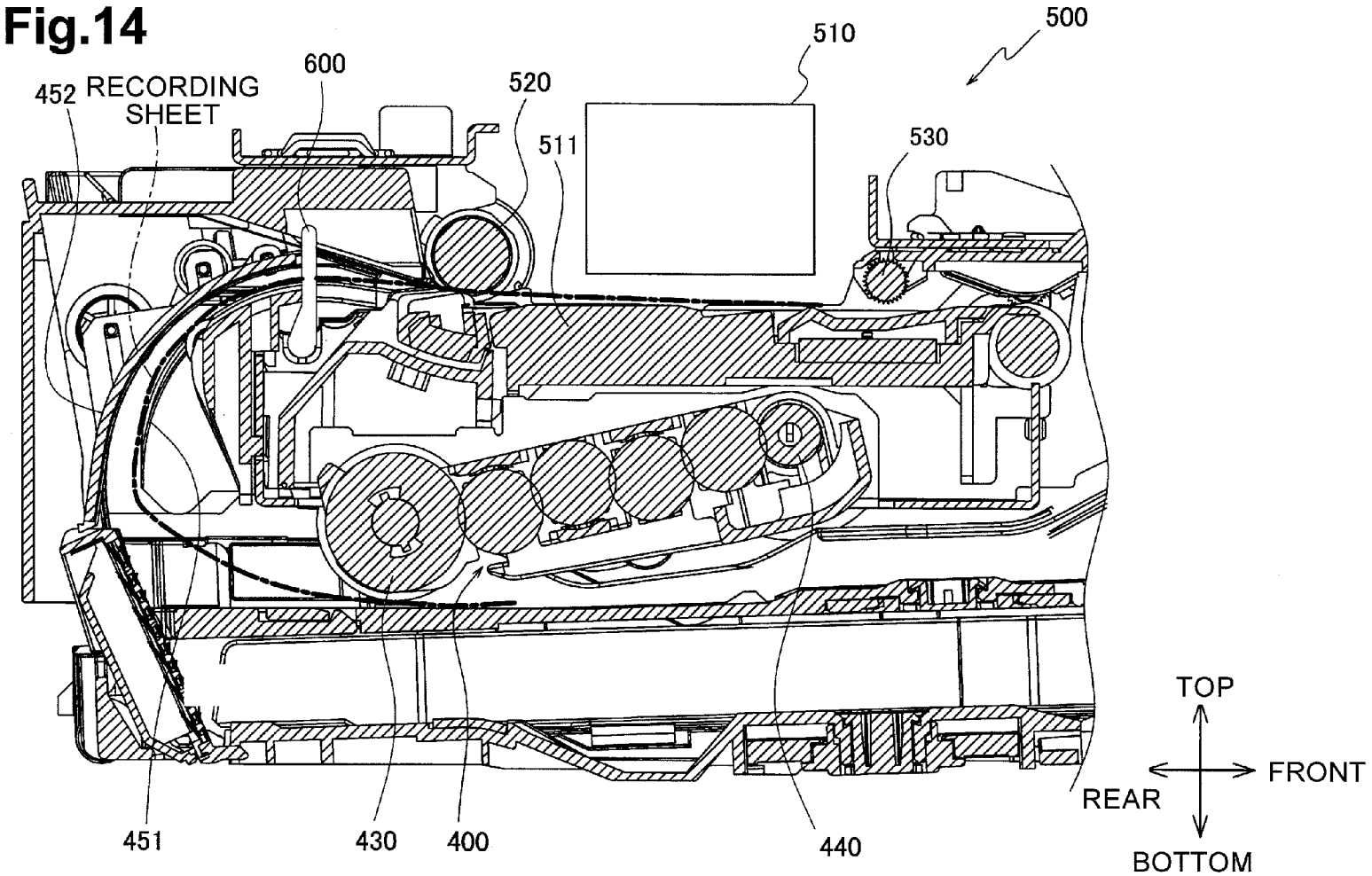
FIG. 14 shows an image forming apparatus in a state where the recording sheet loaded in the second sheet feed tray is being conveyed according to the second illustrative embodiment of the invention.
Figure 15:
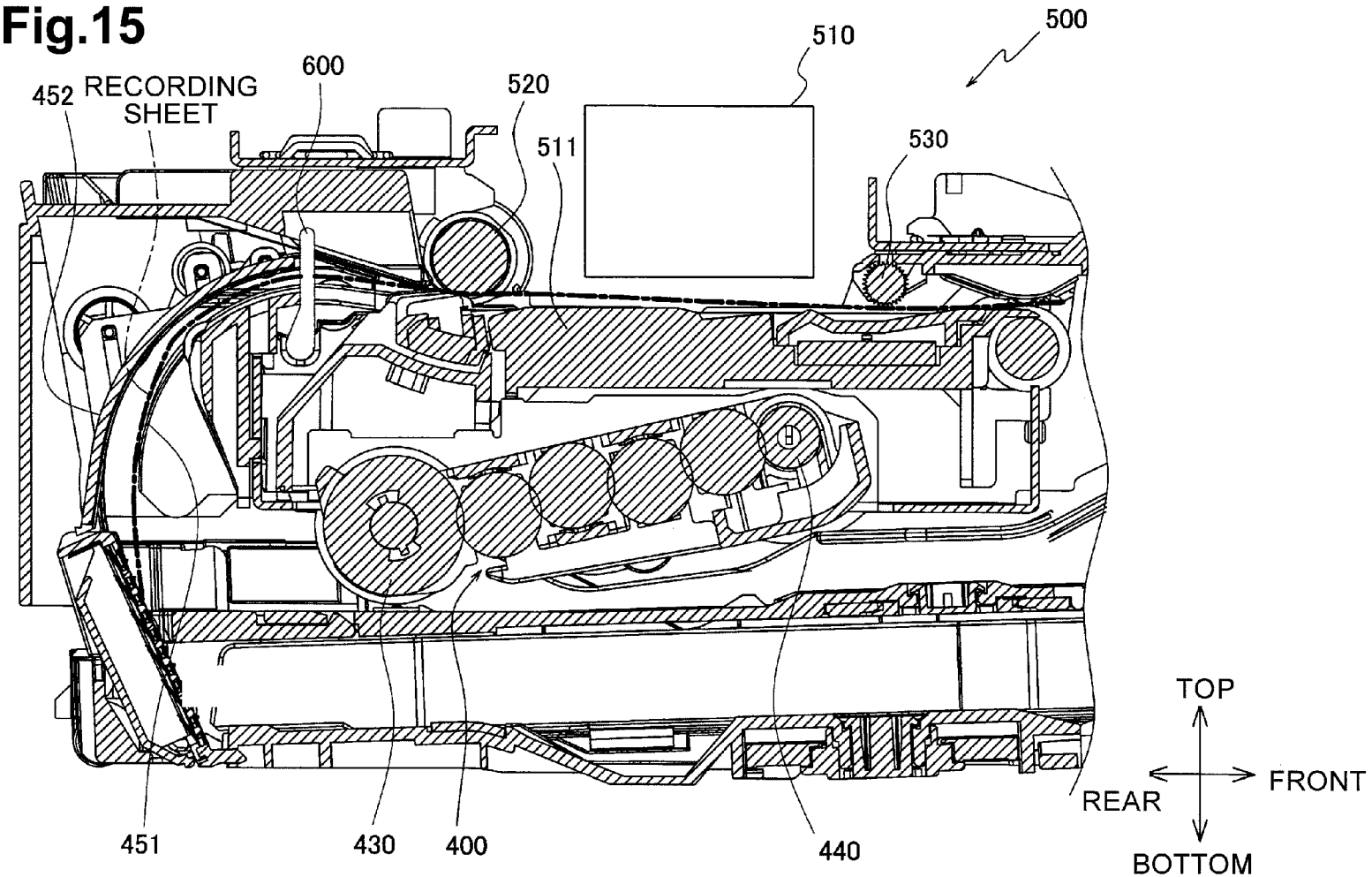
FIG. 15 shows an image forming apparatus in a state where the recording sheet loaded in the second sheet feed tray is being conveyed according to the second illustrative embodiment of the invention.

FIGS. 13 to 15 shows a process of conveying a recording sheet placed in the second sheet supply tray 320. A recording sheet having a conveying force applied thereto by the sheet feed rollers 430 is first conveyed toward the recording head unit 510 while sliding in contact with the outer guide member 452, as shown in FIG. 13.

As the recording sheet is conveyed, the state of the recording sheet is gradually changed from the state where the recording sheet is being conveyed while contacting the outer guide member 452 (refer to FIG. 13) to a state where the recording sheet is being conveyed while contacting the inner guide member 451 as shown in FIG. 14. Finally, as shown in FIG. 15, the recording sheet is disengaged from the sheet feed rollers 430.

When a recording sheet having high stiffness, such as a calendared sheet, is used, a tension force acting on the recording sheet in the conveying direction becomes larger while the recording sheet is in contact with the inner guide member 451 as compared to when the recording sheet is being conveyed while in contact with the outer guide member 452. In addition, friction caused at a contact surface between the recording sheet and the inner guide member 451 may be greater than friction caused at a contact surface between the recording sheet and the outer guide member 452.

Therefore, the controller 700 of the second illustrative embodiment specifies a time at which the recording sheet starts contacting the inner guide member 451 by separating from the outer guide member 452, in accordance with a time that has elapsed since detection of the leading edge of the recording sheet by the register sensor 600. Then, the controller 700 controls the conveyor roller 520 such that a correction amount of the rotation of the conveyor roller 520 when the recording sheet is in contact with the inner guide member 451 is greater than a correction amount of the rotation of the conveyor roller 520 when the recording sheet is in contact with the outer guide member 452.

Figure 16:
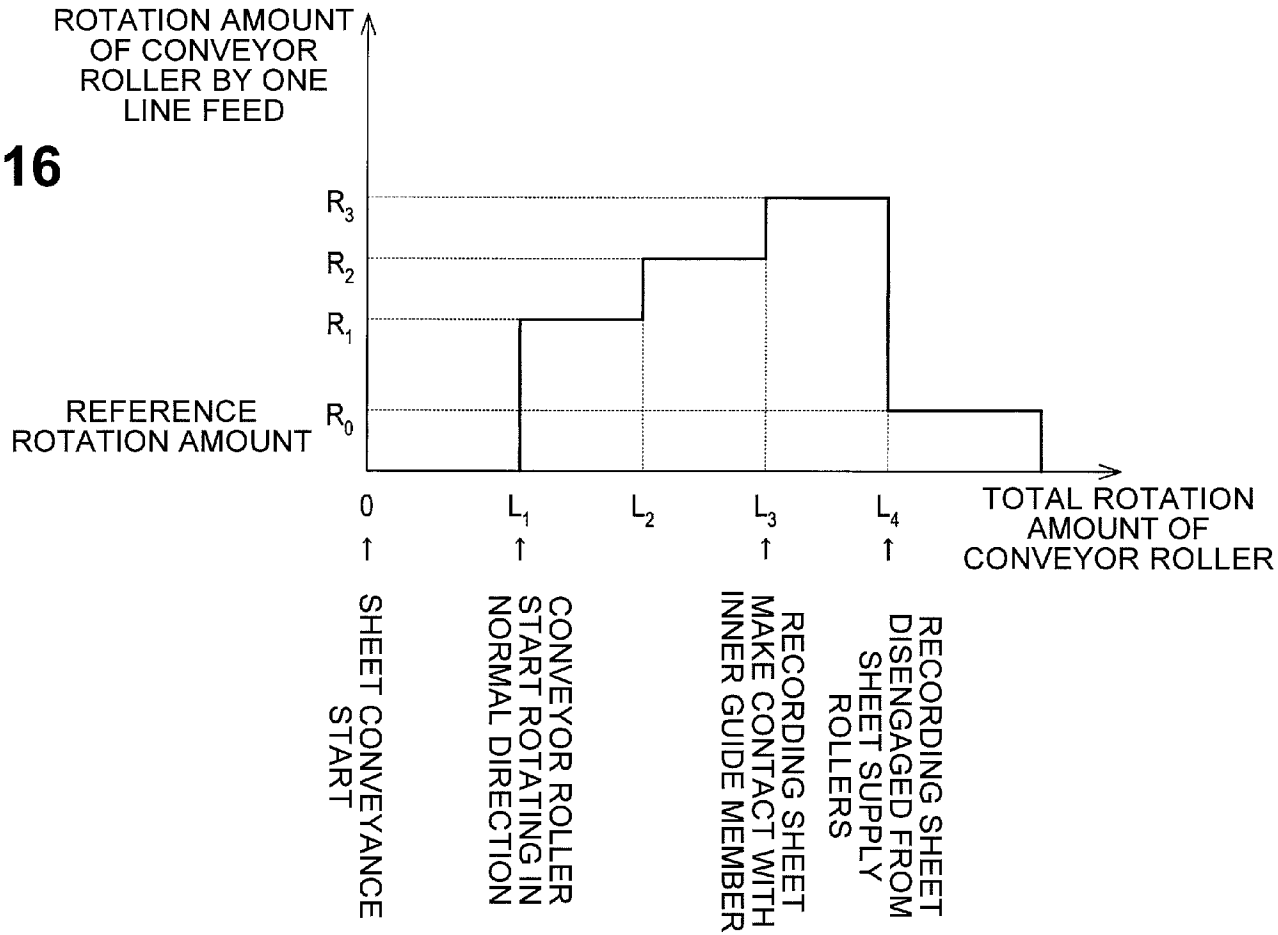
FIG. 16 is a chart showing a change in a rotation amount of the conveyor roller when a second type of sheet is used as a recording sheet according to the second illustrative embodiment of the invention.

FIG. 16 is a chart showing a change in the rotation amount of the conveyor roller 520 when a calendared sheet is used as a recording sheet. In the second illustrative embodiment, the rotation amount of the conveyor roller 520 is corrected to the first rotation amount R1, which is greater than the reference rotation amount R0, when the total rotation amount of the conveyor roller 520 has reached a first predetermined amount of rotation (e.g., $L_1$ of FIG. 16) after the register sensor 600 has detected the leading edge of the recording sheet in the conveying direction.

After that, when the recording sheet continues to be conveyed with its trailing edge contacting the sheet feed rollers 430, a tension (back tension) in the conveying direction acting on the recording sheet gradually becomes larger. Thus, the controller 700 corrects the rotation amount of the conveyor roller 520 to a second rotation amount R2, which is greater than the first rotation amount R1, when the total rotation amount of the conveyor roller 520, after the rotation amount of the conveyor roller 520 has been changed to the first rotation amount R1, has reached a second predetermined total rotation amount (e.g., $L_2$ in FIG. 16).

The controller 700 corrects the rotation amount of the conveyor roller 520 to a third rotation amount R3, which is greater than the second rotation amount, when the total rotation amount of the conveyor roller 520, after the rotation amount of the conveyor roller 520 has been changed to the second rotation amount 12, has reached a third predetermined total rotation amount (e.g., $L_3$).

After that, the controller 700 adjusts the rotation amount of the conveyor roller 520 to the reference rotation amount R0, assuming that the trailing edge of the recording sheet is disengaged from the sheet feed rollers 430 when the total rotation amount of the conveyor roller

520 has reached a fourth predetermined total rotation amount of the conveyor roller 520, determined after the register sensor 600 has detected the leading edge of the recording sheet.

As described above, in the second illustrative embodiment, the rotation amount of the conveyor roller 520 is corrected in accordance with whether the recording sheet is being conveyed in contact with the outer guide member 452 or the inner guide member 451. Thus, the conveying amount of the recording sheet can be further accurately controlled.

In the above-described illustrative embodiments, the position of the recording sheet in the conveying path L is determined in accordance with the detection timing of the register sensor 600. In response to this detecting timing, the rotation amount of the conveyor roller 520 is corrected. The correction amount used in the above-described illustrative embodiments may be a fixed value that is determined during a development stage of the image forming apparatus 100.

In a third illustrative embodiment, the correction amount is changed in accordance with a rotational load (a conveying load) of the conveyor roller 520.

In other words, the controller 700 calculates the rotational load (the conveying load) of the conveyor roller 520 in accordance with a difference between an actual rotation amount of the conveyor roller 520 (e.g., a value detected by the encoder 705) and a rotation amount of the conveyor roller 520 (the LF motor 703) ordered by the controller 700 (a control target rotation amount). The correction amount of the conveyor roller 520 becomes greater as the conveying load of the conveyor roller 520 increases.

Figure 17:
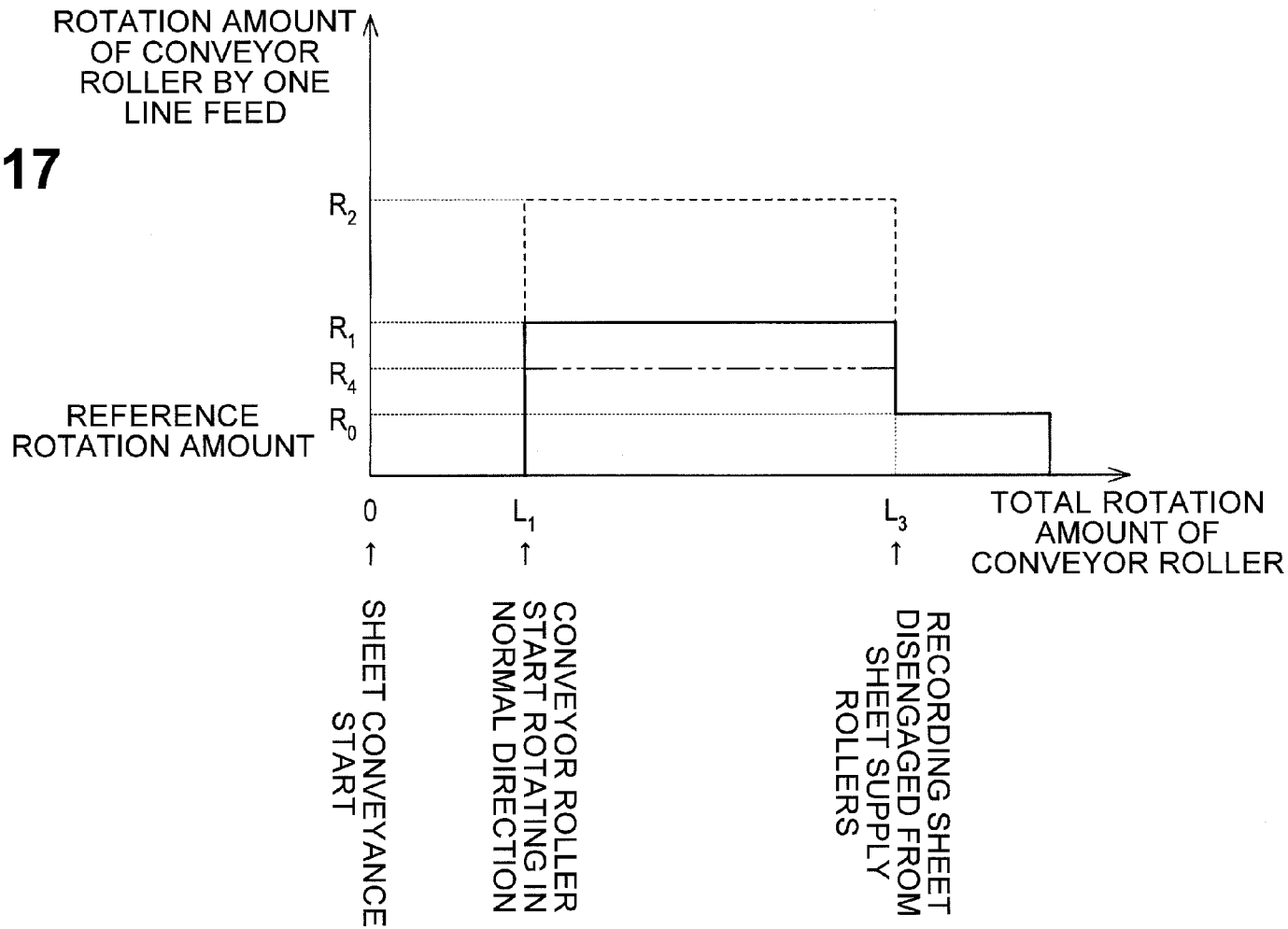
FIG. 17 is a chart showing a change in a rotation amount of the conveyor roller when an image is formed on a recording sheet at low resolution according to a third illustrative embodiment of the invention.

FIG. 17 is a chart showing a change in the rotation amount (the correction amount) of the conveyor roller 520 when an image is formed on a calendared sheet at low resolution (for example, 1200 dpi). As indicated by a solid line in FIG. 17, when an image is formed on a calendared sheet at low resolution, the controller 700 controls the conveyor roller 520 to rotate a uniform correction amount (a first rotation amount R1) when the recording sheet (the calendared sheet) is in contact with the sheet feed rollers 430.

When an actual conveying load of the conveyor roller 520 is greater than the conveying load assumed or determined during the development stage, the controller 700 allows the conveyor roller 520 to rotate at a second rotation amount R2 (indicated by a thick dashed line in FIG. 17), which is greater than the first rotation amount R1. When the actual conveying load of the conveyor roller 520 is smaller than the conveying load assumed or determined during the development stage, the controller 700 allows the conveyor roller 520 to rotate at a fourth rotation amount R4 (indicated by a dot and dashed line in FIG. 17), which is smaller than the first rotation amount R1.

With this control of this embodiment, the conveying amount of the recording sheet can be more accurately controlled. Thus, the occurrence of banding caused due to the slippage of the recording sheet in the conveyor roller 520 can be reduced.

In the above-described illustrative embodiments, has aspects have been applied to an inkjet printer. However, the application of the aspects is not limited to the specific embodiments thereof. For example, aspects of the invention can be applied to an electrophotographic image forming device, such as a laser printer, a thermal printer and a copying machine.

In the above-described illustrative embodiments, the aspects have been applied to a multifunctional machine. However, the application of the various aspects is not limited to the specific embodiments thereof and can be applied to an image forming device having a printing function only.

In addition, the conveyor roller 520 and the sheet feed rollers 430 are driven by a common motor (the LF motor 703), however, the invention is not limited to the specific embodiment thereof.

The invention can be applied to an image forming device having an intermediate conveyor roller that applies a conveying force to a recording sheet wherein the intermediate conveyor roller is disposed within a conveying path between the sheet feed rollers 430 and the conveyor roller 520.

What is claimed is:

1. An image forming apparatus comprising:

an image forming device configured to form an image on a recording sheet;

a sheet feed tray that is configured to be loaded with the recording sheet;

a sheet feed roller configured to convey the recording sheet toward the image forming device by rotating while contacting the recording sheet;

a conveyor roller disposed downstream of the sheet feed roller in a recording sheet conveying direction, the conveyor roller configured to apply a conveying force on the recording sheet by rotating while contacting the recording sheet;

a sheet position detection device configured to detect a position of the recording sheet, fed from the sheet feed tray, in a recording sheet conveying path (L) extending between the sheet feed tray and the image forming device, wherein the conveying path is defined by an outer guide member and an inner guide member of the apparatus; and a conveyor roller control device configured to control a rotation amount of the conveyor roller over a reference time period in accordance with the position of the recording sheet detected by the sheet position detection device, the conveyor roller control device increasing the rotation amount of the conveyor roller to a first rotation amount, wherein the first rotation amount of the conveyor roller over the reference time period is greater, when the recording sheet being conveyed is in contact with the sheet feed roller and the conveyor roller, than a second rotation amount of the conveyor roller over the reference time period corresponding to when the recording sheet being conveyed is not in contact with the sheet feed roller while being in contact with the conveyor roller, wherein the conveyor roller control device is further configured to increase the rotation amount of the conveyor roller to a third rotation amount over the reference time period upon determining that the recording sheet has transitioned from a first state in which the recording sheet is in contact with the outer guide member to a second state in which the recording sheet is in contact with the inner guide member, wherein the third rotation amount is greater than the first rotation amount.

2. The image forming apparatus according to claim 1, further comprising a conveying load detection device that is configured to detect a conveying load of a recording sheet while the recording sheet is in contact with the conveyor roller, wherein the conveyor roller control device increases the first rotation amount of the conveyor roller when the conveying load detected by the conveying load detection device increases.

3. The image forming apparatus according to claim 1, wherein the conveying path is substantially U-shaped and is defined by the inner guide member and the outer guide member that are disposed at an inner side and an outer side with respect to the conveying path, respectively, to guide the recording sheet, and the conveyor roller control device increases the rotation amount of the conveyor roller in accordance with the position of the recording sheet in the sheet conveying path when the recording sheet is in contact with both the sheet feed roller and the conveyor roller.

4. The image forming apparatus according to claim 1, further comprising a large sheet feed tray that is disposed under the sheet feed tray and is configured to load a second recording sheet that is larger than the recording sheet loaded in the sheet feed tray, wherein the image forming device is disposed above the sheet feed tray, and the conveyor roller control device increases the first rotation amount of the conveyor roller, when the recording sheet is in contact with the sheet feed roller, to be greater than a third fourth rotation amount of the conveyor roller over the reference time period while the recording sheet is not in contact with the sheet feed roller, when the recording sheet is fed from the sheet feed tray.

5. The image forming apparatus according to claim 1, wherein determining that the recording sheet has transitioned from the first state to the second state includes determining that an amount of time lapsed after detection of a leading edge of the recording sheet by a sensor has reached a predefined amount of elapsed time, wherein the sensor is disposed between the conveyor roller and the sheet feed roller.

6. An image forming apparatus comprising:

a sheet feed roller configured to convey a recording sheet;

a conveyor roller disposed downstream of the sheet feed roller in a recording sheet conveying direction, the conveyor roller configured to apply a conveying force on the recording sheet by rotating while contacting the recording sheet;

a sheet position detection device configured to detect a position of the recording sheet, fed from the sheet feed tray, in a recording sheet conveying path; and a conveyor roller control device configured to control a rotation amount of the conveyor roller over a reference time period in accordance with the position of the recording sheet detected by the sheet position detection device, the conveyor roller control device controlling the rotation amount by:

increasing the rotation amount to a first rotation amount of the conveyor roller over the reference time period, when the recording sheet being conveyed is in a first position where the recording sheet contacts the sheet feed roller and the conveyor roller, and increasing the rotation amount to a second rotation amount over the reference time period from the first rotation amount upon determining that the recording sheet is in a second position relative to inner and outer guide members of the image forming apparatus.

7. The image forming apparatus according to claim 6, further comprising a conveying load detection device that is configured to detect a conveying load of a recording sheet while the recording sheet is in contact with the conveyor roller, wherein the conveyor roller control device further increases the rotation amount of the conveyor roller when the conveying load detected by the conveying load detection device increases.

8. The image forming apparatus according to claim 6, wherein the conveying path is substantially U-shaped and is defined by the inner guide member and the outer guide member that are disposed at an inner side and an outer side with respect to the conveying path, respectively, to guide the recording sheet, and wherein the second position corresponds to a state in which the recording sheet is in contact with the inner guide member.

* * * * *

UNITED STATES PATENT AND TRADEMARK OFFICE

CERTIFICATE OF CORRECTION

PATENT NO. : 7,883,282 B2
APPLICATION NO. : 11/855389
DATED : February 8, 2011
INVENTOR(S) : Masatoshi Izuchi et al.

It is certified that error appears in the above-identified patent and that said Letters Patent is hereby corrected as shown below:

IN THE CLAIMS:

Column 16, Claim 4, Line 9:
Please delete "third"

Signed and Sealed this
Twenty-first Day of August, 2012

David J. Kappos

David J. Kappos
*Director of the United States Patent and Trademark Office*